US010648742B2

(12) United States Patent
Yoshimura et al.

(10) Patent No.: US 10,648,742 B2
(45) Date of Patent: May 12, 2020

(54) FINLESS HEAT EXCHANGER, OUTDOOR UNIT OF AN AIR-CONDITIONING APPARATUS INCLUDING THE FINLESS HEAT EXCHANGER, AND INDOOR UNIT OF AN AIR-CONDITIONING APPARATUS INCLUDING THE FINLESS HEAT EXCHANGER

(71) Applicant: Mitsubishi Electric Corporation, Chiyoda-ku (JP)

(72) Inventors: Susumu Yoshimura, Chiyoda-ku (JP); Takashi Matsumoto, Chiyoda-ku (JP); Shigeyoshi Matsui, Chiyoda-ku (JP); Shoji Yamada, Chiyoda-ku (JP); Akira Ishibashi, Chiyoda-ku (JP)

(73) Assignee: Mitsubishi Electric Corporation, Ciyoda-ku (JP)

( * ) Notice: Subject to any disclaimer, the term of this patent is extended or adjusted under 35 U.S.C. 154(b) by 19 days.

(21) Appl. No.: 16/077,654

(22) PCT Filed: Mar. 15, 2017

(86) PCT No.: PCT/JP2017/010363

§ 371 (c)(1),
(2) Date: Aug. 13, 2018

(87) PCT Pub. No.: WO2017/159726

PCT Pub. Date: Sep. 21, 2017

(65) Prior Publication Data

US 2019/0049186 A1 Feb. 14, 2019

(30) Foreign Application Priority Data

Mar. 16, 2016 (JP) ..... 2016-052941

(51) Int. Cl.
*F28F 9/02* (2006.01)
*F28D 1/047* (2006.01)
(Continued)

(52) U.S. Cl.
CPC ..... *F28D 1/047* (2013.01); *F25B 39/00* (2013.01); *F28F 1/02* (2013.01); *F28F 1/04* (2013.01); *F28F 9/02* (2013.01)

(58) Field of Classification Search
CPC .... F24F 5/0089; F24F 1/02; F24F 1/04; F24F 9/02; F28D 1/05366; F28D 1/047; F25B 39/04
See application file for complete search history.

(56) References Cited

U.S. PATENT DOCUMENTS

2008/0029256 A1* 2/2008 Durr ..... F28D 1/05366 165/153
2008/0047297 A1* 2/2008 Jung ..... F25B 39/04 62/513
(Continued)

FOREIGN PATENT DOCUMENTS

JP 10-9198 Y1 6/1935
JP 39-3196 B1 3/1964
(Continued)

OTHER PUBLICATIONS

International Search Report dated Jun. 6, 2017 in PCT/JP2017/010363 filed Mar. 15, 2017.
(Continued)

*Primary Examiner* — Davis D Hwu
(74) *Attorney, Agent, or Firm* — Oblon, McClelland, Maier & Neustadt, L.L.P.

(57) ABSTRACT

A finless heat exchanger includes a pair of headers each including a pipe-shaped portion extending in a first direction, and branching portions formed on the pipe-shaped portion, and flat pipes each having a flat sectional shape elongated in one direction, the flat pipes being arrayed in the first direction and connecting the branching portions of the headers. Flat surfaces of adjacent two flat pipes face each other and the adjacent two flat pipes each have a side surface
(Continued)

facing a second direction orthogonal to the first direction. The flat pipes connect the branching portions, the side surface of each of the flat pipes has a wave shape, and adjacent flat pipes are prevented from contacting each other. Both the side surfaces are opened so that air flows in from a side corresponding to one side surface in the second direction and flows out from a side in the second direction.

17 Claims, 14 Drawing Sheets

(51) Int. Cl.

| | |
|---|---|
| ***F25B 39/00*** | (2006.01) |
| ***F28F 1/04*** | (2006.01) |
| ***F28F 1/02*** | (2006.01) |

(56) References Cited

U.S. PATENT DOCUMENTS

| | | | | |
|---|---|---|---|---|
| 2008/0092587 | A1 | 4/2008 | Gorbounov et al. | |
| 2008/0238637 | A1* | 10/2008 | Ghabra | B60R 25/24 340/426.36 |
| 2013/0032320 | A1 | 2/2013 | Shikazono et al. | |
| 2015/0338108 | A1* | 11/2015 | Murakami | F24F 5/0089 165/49 |
| 2018/0238637 | A1* | 8/2018 | Ishibashi | F25B 39/00 |

FOREIGN PATENT DOCUMENTS

| | | | |
|---|---|---|---|
| JP | 1-157959 | A | 6/1989 |
| JP | 2000-33781 | A | 12/2000 |
| JP | 2007-232339 | A | 9/2007 |
| JP | 2008-528943 | A | 7/2008 |
| JP | 2008-196732 | A | 8/2008 |
| JP | 2009-270787 | A | 11/2009 |
| JP | 2011-158200 | A | 8/2011 |
| WO | WO 2005/073655 | A1 | 8/2005 |
| WO | WO 2006/083449 | A2 | 8/2006 |

OTHER PUBLICATIONS

Japanese Office Action dated Jun. 18, 2019, in Patent Application No. 2018-505975, citing document AO therein, 11 pages (with English translation).

* cited by examiner

FINLESS HEAT EXCHANGER, OUTDOOR UNIT OF AN AIR-CONDITIONING APPARATUS INCLUDING THE FINLESS HEAT EXCHANGER, AND INDOOR UNIT OF AN AIR-CONDITIONING APPARATUS INCLUDING THE FINLESS HEAT EXCHANGER

TECHNICAL FIELD

The present invention relates to a finless heat exchanger to be used in an air-conditioning apparatus such as a room air-conditioning apparatus and a package air-conditioning apparatus, an outdoor unit of an air-conditioning apparatus including the finless heat exchanger, and an indoor unit of an air-conditioning apparatus including the finless heat exchanger.

BACKGROUND ART

As a heat exchanger to be used in an air-conditioning apparatus such as a room air-conditioning apparatus and a package air-conditioning apparatus, a finless heat exchanger and a fin-and-tube heat exchanger have been known. In the fin-and-tube heat exchanger using pipes and fins, thermal contact resistance is generated between the pipe and the fin, and resistance is also generated in a fin portion due to thermal conduction of the fins. In contrast, the finless heat exchanger does not include fins, and hence resistance due to thermal conduction of the fins is almost zero. Further, thermal contact resistance generated between the pipe and the fin is also zero. Consequently, the heat exchanger performance is enhanced. Further, when the finless heat exchanger is used as an evaporator, condensed water flows downward through spaces defined by flat pipes while meandering in the gravity direction. Consequently, the drainage performance is satisfactory. Further, in a case in which the finless heat exchanger is used as a heat exchanger of an outdoor unit, also at the time of a defrosting operation after an operation causing frost formation, accumulation of ice on a lower part of the heat exchanger can be prevented.

As the finless heat exchanger to be used in the air-conditioning apparatus, for example, Patent Literature 1 below has the following configuration. Specifically, a plurality of flat-shaped heat transfer pipes each accommodating a plurality of passages are arrayed at a predetermined pitch in a direction orthogonal to an air-passing direction so that flat surfaces of the heat transfer pipes are parallel to the air-passing direction. Both ends of the heat transfer pipes are connected to an inlet header and an outlet header. The heat exchanger has a configuration in which an expansion valve is provided in the inlet header to improve refrigerant distribution so that the surface areas of all the flat pipes (heat transfer area) are utilized effectively without waste, thereby the heat exchange performance can be improved.

CITATION LIST

Patent Literature

Patent Literature 1: Japanese Translation of PCT International Application No. 2008-528943

SUMMARY OF INVENTION

Technical Problem

In a finless heat exchanger as in the heat exchanger of Patent Literature 1 above, the heat transfer area is smaller than that in the fin-and-tube heat exchanger, and consequently, there is a limitation in enhancement in performance as the fin-and-tube heat exchanger. Further, in the related-art finless heat exchanger, a fact that a relationship between the plate thickness of the flat pipes and an array pitch of the flat pipes is not appropriate is one of reasons why the heat exchanger performance is not enhanced due to air flow resistance.

The present invention has been made to solve the problem described above, and has an object to provide a finless heat exchanger in which heat exchanger performance can be enhanced with a heat transfer area increased to enhance heat transfer performance, an outdoor unit of an air-conditioning apparatus including the finless heat exchanger, and an indoor unit of an air-conditioning apparatus including the finless heat exchanger.

Solution to Problem

According to an embodiment of the present invention, there is provided a finless heat exchanger, including a pair of headers each including a pipe-shaped portion extending in a first direction, and a plurality of branching portions formed on the pipe-shaped portion at a predetermined interval in the first direction, and a pipe group including a plurality of flat pipes each having a flat sectional shape elongated in one direction, the plurality of flat pipes being arrayed in the first direction and connecting between the plurality of branching portions of one of the pair of headers and the plurality of branching portions of another of the pair of headers. The finless heat exchanger has at least one passage structure in which a flat surface of one of adjacent two flat pipes and a flat surface of another of the adjacent two flat pipes of the plurality of flat pipes of the pipe group face each other and in which the adjacent two flat pipes of the plurality of flat pipes of the pipe group each have a side surface facing a second direction orthogonal to the first direction, the finless heat exchanger is configured to exchange heat between air flowing through spaces defined by the plurality of flat pipes and refrigerant while the refrigerant is supplied from one of the pair of headers to the plurality of flat pipes to flow to another of the pair of headers, the plurality of flat pipes are each bent in a wave shape and connect between the plurality of branching portions of the one and the other of the pair of headers, and the side surface of each of the plurality of flat pipes has a wave shape as viewed in the second direction, the plurality of flat pipes of the pipe group that are adjacent to each other are prevented from being held in contact with each other, and both the side surfaces are opened so that the air flows in from a side corresponding to one side surface in the second direction and flows out from a side corresponding to another side surface in the second direction.

Advantageous Effects of Invention

According to an embodiment of the present invention, the following configuration is provided. Specifically, the flat pipes are each bent into a wave shape in a pipe passage direction in which the refrigerant flows. The side surfaces each have a wave shape as viewed in the second direction. The adjacent flat pipes are prevented from being held in contact with each other. Consequently, the surface areas of the flat pipes, that is, the heat transfer area is increased, thereby the heat transfer performance can be enhanced. Further, in a case in which the number of the flat pipes is increased to increase the heat transfer area, the air flow resistance is increased due to reduction in array pitch.

However, as the flat pipes are each formed to have a thickness smaller than the array pitch, the performance of the heat exchanger can be enhanced while increase in air flow resistance is reduced.

DESCRIPTION OF EMBODIMENTS

Figure 1:
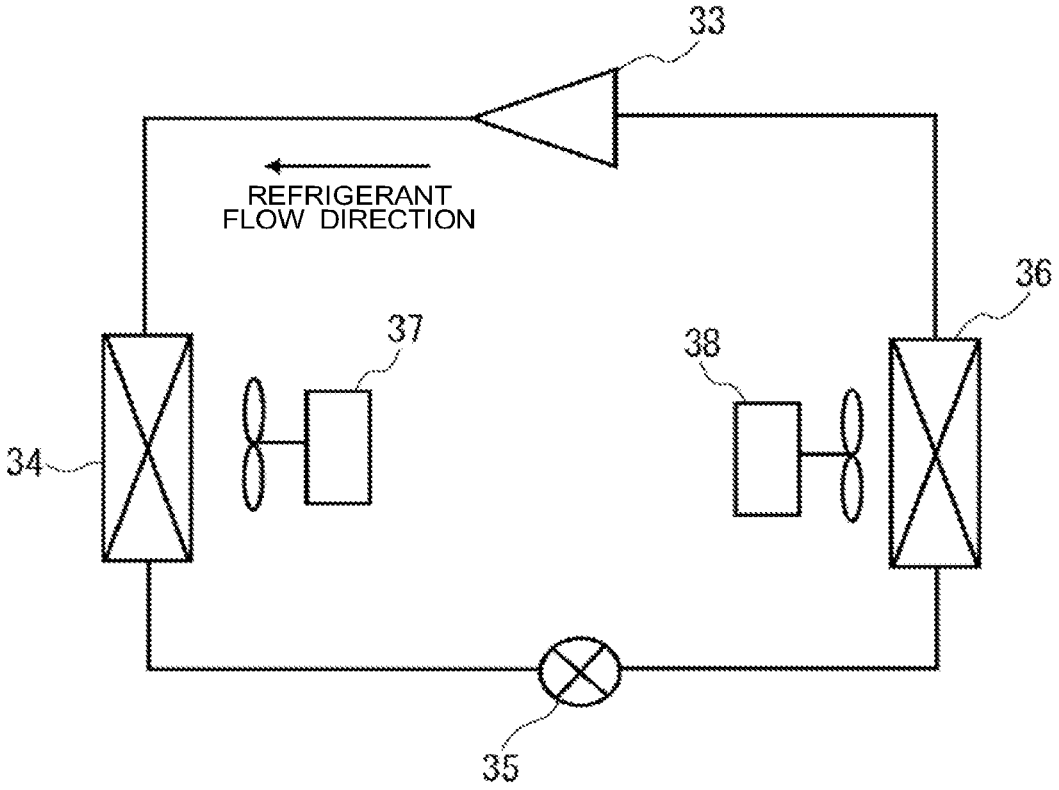
FIG. 1 is a schematic view for illustrating a configuration example of a refrigerant circuit of an air-conditioning apparatus.

The present invention is described below with reference to embodiments illustrated in the drawings. In the drawings, the same or corresponding parts are denoted by the same reference signs, and description of the parts is omitted or simplified as appropriate. Moreover, shapes, sizes, arrangements, and other features of components illustrated in the drawings may be changed as appropriate within the scope of the present invention.

Embodiment 1

FIG. 1 is a schematic view for illustrating a configuration example of a refrigerant circuit of an air-conditioning apparatus. As illustrated in FIG. 1, the air-conditioning apparatus includes a refrigerant circuit in which a compressor 33, a condensing heat exchanger 34, an expansion device 35, and an evaporating heat exchanger 36 are sequentially connected by refrigerant pipes. Further, air-sending devices 37 and 38 configured to send air are provided to the condensing heat exchanger 34 and the evaporating heat exchanger 36, respectively. In Embodiment 1 illustrated in FIG. 1, there is illustrated a case of a heating circuit in which the condensing heat exchanger 34 is mounted to an indoor unit, and the evaporating heat exchanger 36 is mounted to an outdoor unit.

The compressor 33 is configured to compress refrigerant into a high-temperature and high-pressure state, and to discharge the refrigerant. For example, the compressor 33 is of a capacity-controllable type that is capable of controlling a rotation frequency by an inverter circuit. An upstream side of the compressor 33 is connected to the evaporating heat exchanger 36, and a downstream side of the compressor 33 is connected to the condensing heat exchanger 34.

The condensing heat exchanger 34 is configured to exchange heat between the refrigerant discharged from the compressor 33 and a heat medium such as air and water to condense and liquefy the refrigerant. An inflow side of the condensing heat exchanger 34 is connected to one end of the compressor 33, and an outflow side of the condensing heat exchanger 34 is connected to one end of the expansion device 35.

The expansion device 35 is configured to decompress the supplied refrigerant to expand the refrigerant. When the expansion device 35 is, for example, an electronic expansion valve, an opening degree is adjusted in accordance with an instruction from a controller or other device. The expansion device 35 is not limited to the electronic expansion valve, and may be, for example, a capillary tube.

The evaporating heat exchanger 36 is configured to exchange heat between air sucked through an air inlet and refrigerant. Low-pressure refrigerant liquid (or two-phase gas-liquid refrigerant) flows into the evaporating heat exchanger 36, and is subjected to heat exchange with the air so that the refrigerant is evaporated. An inflow side of the evaporating heat exchanger 36 is connected to one end of the expansion device 35, and an outflow side of the evaporating heat exchanger 36 is connected to one end of the compressor 33.

An operation of the air-conditioning apparatus having the above-mentioned configuration is briefly described. The refrigerant having been compressed into the high-temperature and high-pressure state in the compressor 33 is discharged from the compressor 33, and flows into the condensing heat exchanger 34. The refrigerant having flowed into the condensing heat exchanger 34 is subjected to heat exchange with air supplied from the air-sending device 37 to be condensed and liquefied. The refrigerant having been condensed and liquefied flows into the expansion device 35, and is decompressed and expanded into low-temperature and low-pressure two-phase gas-liquid refrigerant. Then, the refrigerant flows into the evaporating heat exchanger 36. The two-phase gas-liquid refrigerant having flowed into the evaporating heat exchanger 36 is subjected to heat exchange with circulating air supplied from the air-sending device 38 to be evaporated and gasified. Then, the refrigerant flows out from the evaporating heat exchanger 36, and is sucked into the compressor 33 again. The refrigerant circuit illustrated in FIG. 1 is merely an example. Configurations and other features of the circuit elements are not limited to those described in the embodiment, and may appropriately be modified within the technical scope of the present invention.

A finless heat exchanger 10 according to Embodiment 1 is suitably used as the evaporating heat exchanger 36 mounted to the outdoor unit of the air-conditioning apparatus among components of the air-conditioning apparatus illustrated in FIG. 1.

Figure 2A:
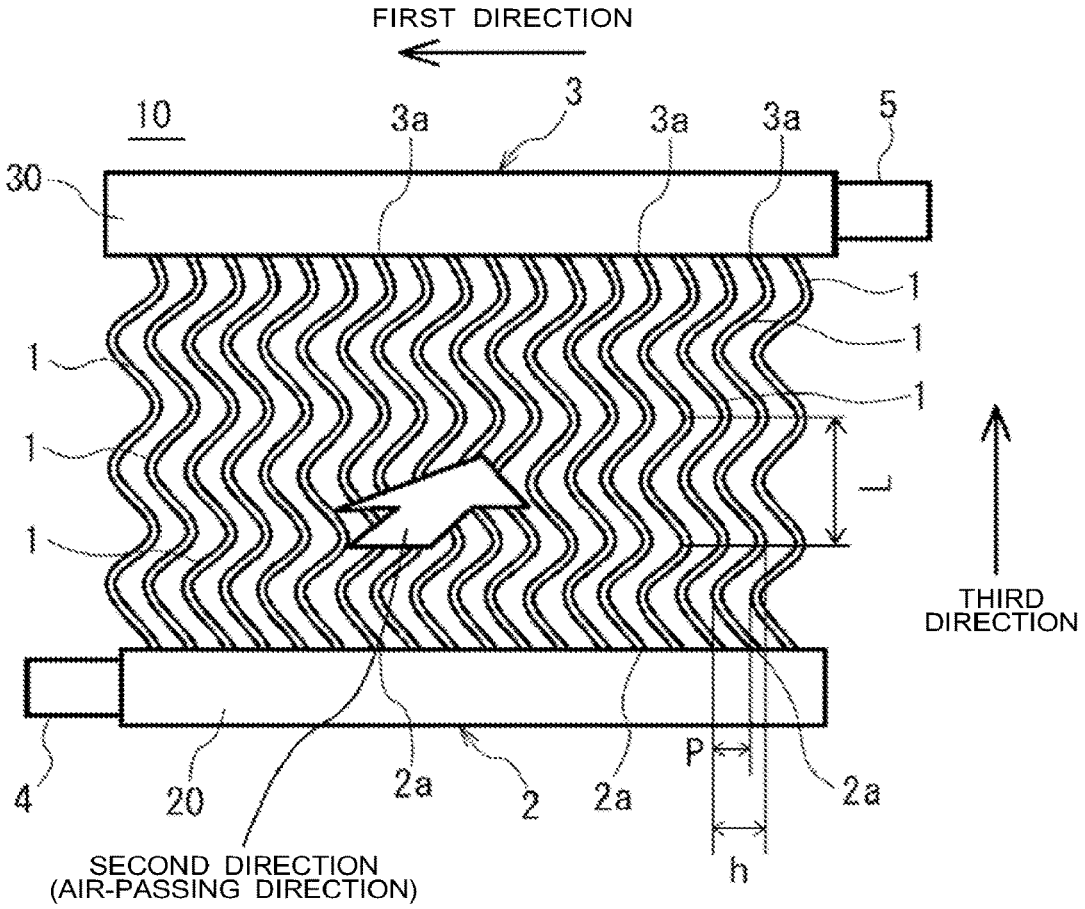
FIG. 2A is a front view for schematically illustrating a finless heat exchanger according to Embodiment 1 of the present invention.
Figure 2B:
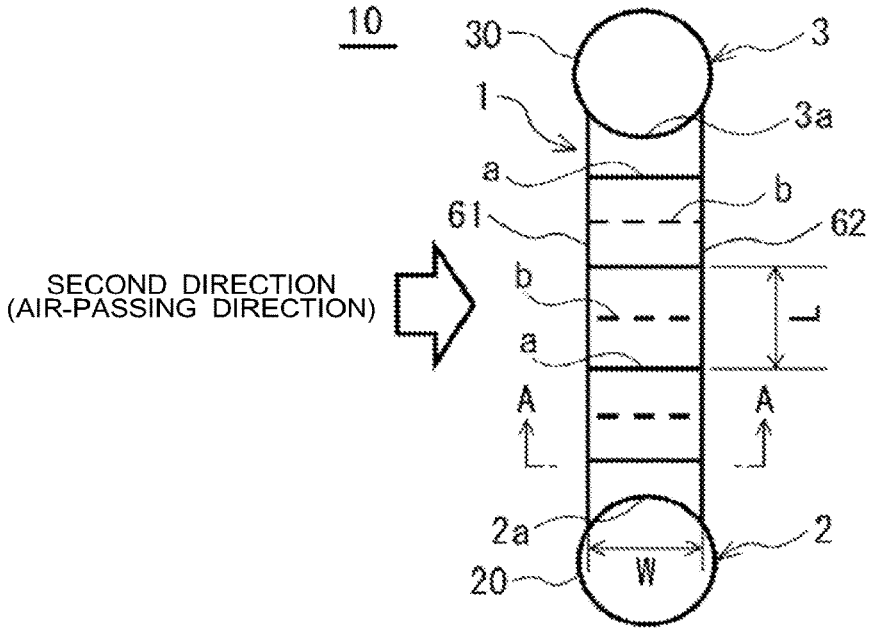
FIG. 2B is a side view of FIG. 2A.
Figure 3:
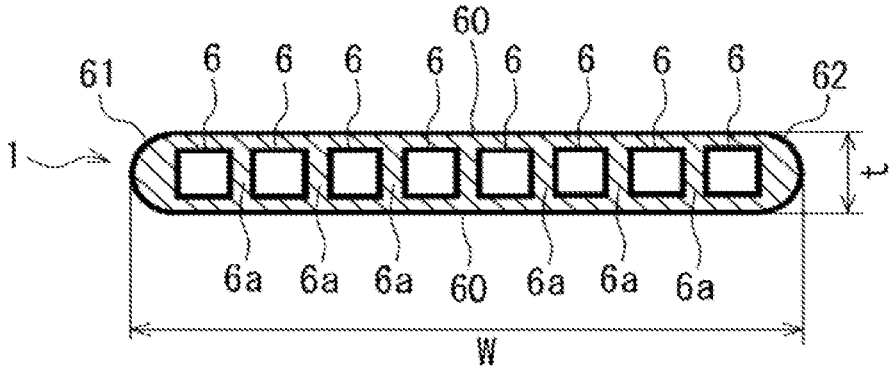
FIG. 3 is a sectional view as viewed in a direction indicated by the arrows of the line A-A illustrated in FIG. 2B.

FIG. 2A is a front view for schematically illustrating the finless heat exchanger according to Embodiment 1 of the present invention. FIG. 2B is a side view of FIG. 2A. FIG. 3 is a sectional view as viewed in a direction indicated by the arrows of the line A-A illustrated in FIG. 2B. As illustrated in FIG. 2B, the finless heat exchanger 10 includes flat pipes 1, an inlet header 2, and an outlet header 3. The flat pipes 1 are a plurality of heat transfer pipes arrayed at a certain interval (pitch) in a direction orthogonal to an air-passing direction as illustrated in FIG. 2A such that flat surfaces 60 arranged upright in the gravity direction are parallel to the air-passing direction in a state in which the heat exchanger 10 is placed. The inlet header 2 and the outlet header 3 are connected to respective ends of the flat pipes 1 in the gravity direction. The inlet header 2 and the outlet header 3 are pipes extending substantially in a horizontal direction. The inlet header 2 and the outlet header 3 are different from each other in height in the gravity direction. The air-passing direction is determined by a direction of air sent from the air-sending device 38 to the heat exchanger 10, a casing in which the heat exchanger 10 is installed, an air passage, or other factor.

As illustrated in FIG. 3, an outer shape of the cross section of the flat pipe 1 is a flat shape in which both ends of two longitudinal sides are connected by short end portions. The longitudinal sides continue in a pipe passage direction (direction in which the pipe extends) to form the flat surfaces 60 of the flat pipe 1. Further, the end portions continue in the pipe passage direction to form side surfaces 61 and 62 of the flat pipe 1. An interval of the two flat surfaces 60 corresponds to a thickness "t" of the flat pipe 1, and a width of the flat surface 60 in the longitudinal direction is represented by W.

As illustrated in FIG. 2A, the flat pipes 1 each have a shape bent in a wave shape along the pipe passage direction, and hence the flat surfaces 60 are each not a planar surface, but has a corrugated shape with mountains and valleys. Further, in FIG. 3, a portion corresponding to the flat surface 60 is illustrated with the straight line, but the flat surface 60 may have, for example, a recess or a local projection having a depth approximately equal to the thickness "t" at a part of the flat surface 60. When the flat surface 60 has the recess or the projection, the flat surface 60 has a groove in the pipe passage direction or a short fin structure at a part of the flat surface 60. A fin that is a recess or a projection may be formed on the side surface 61 or 62 of the flat pipe 1.

A surface that is a longitudinal portion when the flat pipe 1 is viewed in the cross section orthogonal to the pipe passage direction is referred to as the flat surface 60 even when the surface has the wave shape or the corrugated shape as described above. The flat pipe 1 basically has the same cross sectional shape in the pipe passage direction except for the vicinities of both the ends in the pipe passage direction. The thickness "t" and the width W of the flat pipe 1 are constant, and the flat pipe 1 has a belt shape bent in a wave shape.

The groove or the small fin may be the recess or the projection in the flat pipe 1 as described above. However, these groove and fin are included in the structure of the flat pipe 1 itself, and a fin that is a separate component is not fixed to the flat pipe 1. Consequently, the finless heat exchanger 10 exchanges heat mainly at the surfaces of the flat pipes 1.

As illustrated in FIG. 3, the flat pipe 1 accommodates a plurality of passages 6 each having a quadrangular shape and configured to allow refrigerant to flow through the plurality of passages 6. The passages 6 and partitions 6*a* between the adjacent passages 6 continue to both the ends in the pipe passage direction. The plurality of passages 6 are arrayed along the longitudinal direction in cross section. One passage 6 is placed in a thickness direction orthogonal to the longitudinal direction, and the passages 6 are arrayed in one row. The cross sectional shape and the number of the passages 6 are not limited to those of the embodiment illustrated in drawings, and may be, for example, various shapes such as a circular shape and a triangular shape and various numbers.

The inlet header 2 is a header including a pipe-shaped portion 20 extending in parallel to a first direction (right-and-left direction on the drawing sheet of FIG. 2A). The outlet header 3 is a header including a pipe-shaped portion 30 extending in parallel to the first direction. At a predetermined interval P along the first direction, a plurality of branching portions 2*a* are provided on a side of the inlet header 2 and a plurality of branching portions 3*a* are provided on a side of the outlet header 3 that faces the side of the inlet header 2. The pipe-shaped portion 20 of the inlet header 2 and the pipe-shaped portion 30 of the outlet header 3 each have a cylindrical shape, and are connected to the flat pipes 1 so that the inside of the cylinders and the passages 6 of the flat pipes 1 are communicated with each other. In Embodiment 1, the first direction is the horizontal direction. A direction linearly connecting the two sets of the branching portions 2*a* and 3*a* by each of the flat pipes 1 is the pipe passage direction.

The branching portions 3*a* of the outlet header 3 are provided in a third direction orthogonal to the first direction on the plane (up-and-down direction in the drawing sheet of FIG. 2A) and away from the branching portions 2*a* of the inlet header 2, and the flat pipes 1 connect these pairs of branching portions 2*a* and 3*a*. Consequently, the flat pipes 1 are pipes extending in the third direction as a whole. The third direction is a direction linearly connecting the branching portions 2*a* and 3*a*, and is the gravity direction in Embodiment 1.

The inlet header 2 and the outlet header 3 include sets of the pairs of branching portions 2*a* and 3*a* in the first direction, and hence the flat pipes 1 each connecting a set of the pairs. The flat pipes 1 arrayed in the first direction constitute a pipe group. When the finless heat exchanger 10 is viewed in a second direction as illustrated in FIG. 2A, the flat pipes 1 are arrayed at intervals. That is, the second direction is a direction crossing a plane including the first direction of the inlet header 2 and the first direction of the outlet header 3, and corresponds to the air-passing direction. The adjacent flat pipes 1 are provided so that one of the flat surfaces 60 of one of the adjacent flat pipes 1 faces one of the flat surfaces 60 of another one of the adjacent flat pipes 1 each other at an interval. The two side surfaces 61 and 62 at both the ends of the flat surface 60 face the second direction. One side surface 61 is located on a windward side of an air flow. Another side surface 62 is located on a leeward side of the air flow. Both sides corresponding to the side surfaces are opened so that air flows in from the one side surface 61 side and the air flows out from the other side surface 62 side. As illustrated in FIG. 2B, the side surface 61 on the windward side and the side surface 62 on the leeward side each have a linear shape extending in the third direction when the flat pipe 1 is viewed in the first direction.

In a case of the finless heat exchanger to be used in an air-conditioning apparatus, in consideration of an operation as the evaporating heat exchanger, it is required that condensed water be caused to flow downward along an extending direction of the flat pipes 1. Consequently, the third direction needs to be the gravity direction. It is described that the third direction is orthogonal to the first direction on the plane in FIG. 2A. However, the third direction may be oblique to the orthogonal direction at about 20 degrees and, at the maximum, at 45 degrees, at which the condensed water can flow downward along the extending direction of the flat pipes 1, specifically. Similarly, the third direction may also be oblique to a direction orthogonal to the second direction on the plane in FIG. 2B.

Further, a refrigerant connecting pipe 4 is provided to one side end portion (left side end portion in the illustrated example) of the inlet header 2 and a refrigerant connecting pipe 5 is provided to one side end portion (right side end portion in the illustrated example) of the outlet header 3. The refrigerant connecting pipe 4 provided to the side end portion of the inlet header 2 and the refrigerant connecting pipe 5 provided to the side end portion of the outlet header 3 are mounted to the side end portions on opposite sides. Thus, pressure losses in the headers are equalized between the inlet header 2 and the outlet header 3, so that the refrigerant distribution is equalized, thereby the performance of the heat exchanger can be enhanced.

The embodiment in which the inlet header 2 and the outlet header 3 each have a cylindrical shape is illustrated. However, for example, the inlet header 2 and the outlet header 3 may be cylinders each having a polygonal shape or other shapes in cross section with a closing end. Further, in FIG. 2A and FIG. 2B, the example in which the branching portions 2*a* and 3*a* are directly connected to the pipe-shaped portions 20 and 30 of the inlet header 2 and the outlet header 3 is illustrated. However, the branching portions 2*a* and 3*a* may indirectly be connected to the pipe-shaped portions 20 and 30. For example, the inlet header 2 and the outlet header 3 may be headers in which circular holes are opened in the pipe-shaped portions 20 and 30, and adapters for converting the shapes of the passages 6 from a circle into an ellipse are provided between the circular holes and end portions of the flat pipes 1.

As illustrated in FIG. 2A and FIG. 2B, the heat exchanger 10 is configured to exchange heat between air sent by the air-sending device 38 or other components to flow into air flow gaps between the adjacent flat pipes 1, and refrigerant flowing through the passages 6 of the flat pipes 1, and to cause the air to flow out. Refrigerant that is returned after heating in an indoor unit to transfer heat to be liquefied and then being decompressed into a low-temperature and low-pressure two-phase gas-liquid state flows in through the inlet header 2 of the heat exchanger 10 via the refrigerant connecting pipe 4, and is distributed into passages provided as many as the number of the flat pipes 1. Then, the refrigerant receives heat to be evaporated while flowing upward through the passages 6 of the flat pipes 1, passes through the outlet header 3, and flows out through the refrigerant connecting pipe 5. In this manner, the refrigerant circulates the refrigerant circuit.

The finless heat exchanger 10 according to Embodiment 1 includes the pair of headers 2 and 3, and the flat pipes 1 connecting these headers 2 and 3. As illustrated in FIG. 2A, the finless heat exchanger 10 has a passage structure in which the flat pipes 1 each have a sinusoidal wave shape as viewed in the air-passing direction of the air-sending device. With such a configuration, surface areas of the flat pipes 1 are increased. That is, in the heat exchanger 10, the heat transfer area is increased as compared to that of a related-art heat exchanger including flat pipes 1 having a flat plate shape, thereby high heat exchanger performance can be obtained. In particular, as compared to a case in which branching portions 2*a* of an inlet header 2 and branching portions 3*a* of an outlet header 3 that are paired with each other are connected to each other by the related-art flat pipes including straight passages, the long passages 6 for heat exchange are provided on the air flow side, thereby the heat exchanger performance is enhanced. Further, the passages 6 in the inside meander, and hence the flow of the refrigerant is disturbed. Thus, heat exchange with inner walls of the passages 6 is enhanced, thereby the performance of the heat exchanger is enhanced.

Figure 4:
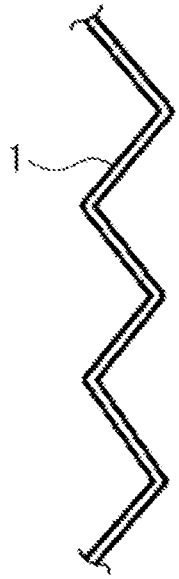
FIG. 4 is an explanatory view for illustrating another shape of flat pipes forming a part of the finless heat exchanger.

FIG. 4 is an explanatory view for illustrating another shape of the flat pipes forming a part of the finless heat exchanger. The shape of the flat pipes 1 is not limited to the sinusoidal wave shape illustrated in FIG. 2A. For example, there may be employed a shape having bent portions such as a triangular wave shape illustrated in FIG. 4, and may be various wave shapes. However, when the shape of the flat pipes 1 has sharp bent portions, a loss of the flow of the refrigerant is increased. Thus, it is desired that the shape of the flat pipes 1 have smooth bent portions such as a sinusoidal wave shape. Further, also in the case in which the flat pipes 1 are bent into a triangular wave shape, it is preferable that a bent angle be 90 degrees or less (or less than 90 degrees) so that an inner angle of the triangular wave is an obtuse angle.

Further, the flat pipes 1 have a wave shape with a cycle larger than an interval P of the branching portions 2*a* and 3*a* instead of a shape having a large number of small bent portions, and thus, the heat exchanger performance can be enhanced while the loss of the flow of the refrigerant is reduced. Further, the flat pipes 1 have a wave shape having the plurality of bent portions in the pipe passage direction, and thus, the width in the first direction can be reduced as compared to a configuration of including the passages each being bent to have one V shape as a whole.

Further, as illustrated in FIG. 2B, in the finless heat exchanger 10 according to Embodiment 1, the mountain fold lines "a" and the valley fold lines "b" of the wave shape of the flat pipe 1 are provided in the horizontal direction to be aligned in height and the mountain fold lines "a" and the valley fold lines "b" of the flat pipes 1 are adjacent to each other on the right and left sides. On the flat surface 60 of the flat pipe 1, the mountain fold lines "a" and the valley fold lines "b" continue in the second direction, specifically, continue from the one side surface 61 located on the windward side to the other side surface 62 located on the leeward side. Further, as illustrated in FIG. 3, the flat pipes 1 each have the thickness "t" that is smaller than an array pitch P. Consequently, a gap through which air flows is secured between the adjacent flat pipes 1. Further, the adjacent flat pipes 1 each have corrugations, and contact of the corrugations of the adjacent flat pipes 1 is prevented. In the finless heat exchanger 10 according to Embodiment 1, phases of the wave shapes of the flat pipes 1 correspond to the third direction, and the wave shape is parallel to the first direction.

Consequently, when the array pitch of the plurality of flat pipes 1 is represented by P, and an amplitude of the wave shape of the flat pipe 1 is represented by h, the array pitch may be set to satisfy a relationship of P≤h. As the array pitch P is reduced, the number of the flat pipes 1 can be increased, and, the heat transfer area can be increased, accordingly. Further, the air flow gap between the adjacent flat pipes 1 and 1 is narrowed. Thus, the heat transfer characteristics is enhanced due to increase in speed in the air flow and reduction in representative length, thereby high heat exchange performance can be obtained.

In a case in which the finless heat exchanger is used in the air-conditioning apparatus, a ratio of power for the air-sending devices 37 and 38 to total power is relatively large. Consequently, it is required to achieve not only the high heat exchange performance but also balance of the power for the air-sending devices 37 and 38 and reduction in noise of the air-sending devices 37 and 38. That is, there is a tendency that, when the air flow gap is narrowed, the air flow resistance as well as the power for the air-sending devices 37 and 38 are increased. However, the heat transfer performance on the surfaces of the flat pipes 1 is higher on the windward side and is reduced toward the leeward side due to an effect of front edges and a large temperature difference between air and refrigerant. Consequently, it is not advisable to increase the width W of the flat pipes 1 in the air-passing direction or to increase the number of array of the plurality of flat pipes 1 in the air-passing direction (for example, four rows or more) for the purpose of enhancing the heat exchanger capability. This is because, although the air flow resistance is increased substantially linearly in proportion to the increase in the width W of the flat pipes 1 (noise is also increased), the heat transfer performance is not increased significantly.

Meanwhile, when the width W is reduced or the number of array is reduced so that only effective heat transfer surfaces on the windward side are utilized, and the array pitch P of the flat pipes 1 is reduced to increase the number of the flat pipes 1, the configuration of the flat pipes 1 is satisfactory. The thickness "t" of the flat pipe 1 is smaller than the array pitch P, and hence increase in air flow resistance due to reduction in array pitch P is smaller than reduction in pressure loss due to the reduction in width W. Consequently, the heat exchange performance can be enhanced while increase in air flow resistance is reduced.

As described above, in the finless heat exchanger 10 according to Embodiment 1, the flat pipes 1 are arrayed so that the flat surfaces 60 be parallel to the air-passing direction. In addition, the width W of the flat pipes 1 and the number of array of the flat pipes 1 in the air-passing direction are reduced so that only the effective heat transfer surfaces on the windward side are utilized. Further, the array pitch P of the flat pipes 1 is reduced to increase the number of the flat pipes 1. In this manner, the heat transfer performance is enhanced. Thus, high heat exchanger performance can be obtained while increase in air flow resistance is reduced.

Further, as a value of (amplitude h of wave shape of flat pipe 1)/(wavelength L of wave shape of flat pipe 1) is increased, the surface area of the flat pipe 1 is increased, and the heat exchanger performance is enhanced. Specifically, in a case assumed in which a value of h/L of the wave shape is 0.289, 0.5, and 0.866, a ratio of a length of the flat pipe 1 having a wave shape (sinusoidal wave) to a length of the flat pipe 1 having a flat shape, that is, a ratio in surface area is 1.155, 1.414, and 2 when the sinusoidal wave is approximated to a triangular wave. Consequently, it is desired that the value of h/L be 0.5 or more. The reason why the value of h/L of the wave shape is set to 0.289, 0.5, and 0.866 is that, for example, in a case in which a practical range of the amplitude h is from 5 to 10 mm, the wavelength L is 17.3 mm, 10 mm, and 5.8 mm. When the amplitude h is excessively large, the width of the heat exchanger 10 is increased. Consequently, it is suitable that the amplitude h be approximately from 5 mm to 10 mm.

Further, in the finless heat exchanger 10 according to Embodiment 1, the array pitch P of the plurality of flat pipes 1 is set to be equal to or smaller than the amplitude h of the wave shape forming the flat pipe 1. Regarding a value of (amplitude h of wave shape of flat pipe 1)/(array pitch P of flat pipes 1), as described above, as h is increased and P is reduced, the surface area of the flat pipe 1 is increased, and the heat exchanger performance is enhanced. Specifically, in a case in which a practical range of the array pitch P is from 2 mm to 5 mm, the amplitude h is approximately from 5 mm to 10 mm, and a value of h/P is from 1 to 5. Consequently, it is desired that the value of h/P be at least 1 or more. The reason why the range of the array pitch P is from 2 mm to 5 mm is that, when the array pitch P is larger than this range, the number of the flat pipes 1 that can be mounted in the width space of the heat exchanger 10 is reduced, so that degradation in performance due to reduction in heat transfer area is significant.

Further, although detailed illustration is omitted, in a case in which the finless heat exchanger 10 according to Embodiment 1 is used as an evaporator, when the value of (amplitude h of wave shape of flat pipe 1)/(wavelength L of wave shape of flat pipe 1) is set to be smaller on the lower side in the gravity direction (up-and-down direction), the degree of inclination of the wave shape is increased on the lower side. Consequently, the condensed water easily flows downward through spaces defined by the flat pipes 1 and 1. Thus, the drainage performance is satisfactory, and the condensed water is less liable to accumulate on the lower part. Further, also at the time of a defrosting operation after an operation causing frost formation, accumulation of ice on the lower part of the heat exchanger 10 can be prevented. The heat exchanger 10 is of a finless type, and hence portions for fixing other parts are not provided on the surfaces. Further, the adjacent flat pipes 1 are prevented from being held in contact with each other, and portions disrupting the water flowing along the surfaces of the flat pipes 1 in the pipe passage direction are not provided. Thus, the heat exchanger 10 is excellent in drainage performance.

The energy efficiency in the air-conditioning apparatus illustrated in FIG. 1 is represented by the following expressions.

The heating energy efficiency is represented by a value of indoor heat exchanger (condensing heat exchanger) capability/entire input.

The cooling energy efficiency is represented by a value of indoor heat exchanger (evaporating heat exchanger) capability/entire input.

Consequently, when the heat exchanger 10 according to Embodiment 1 having the above-mentioned effect is used as the evaporating heat exchanger 36 or the condensing heat exchanger 34, an air-conditioning apparatus having high energy efficiency can be achieved. Further, when the finless heat exchanger 10 according to Embodiment 1 is used as the evaporating heat exchanger 36 and the condensing heat exchanger 34, an air-conditioning apparatus having higher energy efficiency can be achieved.

Further, the air-conditioning apparatus using the finless heat exchanger 10 according to Embodiment 1 can achieve the above-mentioned effect when a refrigerant such as R410A, R32, and HFO1234yf is used.

Further, the finless heat exchanger 10 according to Embodiment 1 can achieve the above-mentioned effects even when any one of various kinds of refrigerating machine oils such as mineral oil-based, alkylbenzene oil-based, ester-based, ether oil-based, and fluorine oil-based lubricants is used, irrespective of whether or not the oils and the refrigerant dissolve in each other.

Further, the finless heat exchanger 10 according to Embodiment 1 is described by exemplifying the case as the evaporator in which the refrigerant flowing through the flat pipes 1 is subjected to heat exchange with the air to receive heat and be evaporated. However, as a matter of course, also in a case as a cooler using refrigerant such as cold water having a temperature lower than the air flow temperature, which is not evaporated, the same effects can be obtained. The same effects can be attained even when gas other than air, liquid, or a gas-liquid mixture fluid is used as a working fluid.

Embodiment 2

Figure 5A:
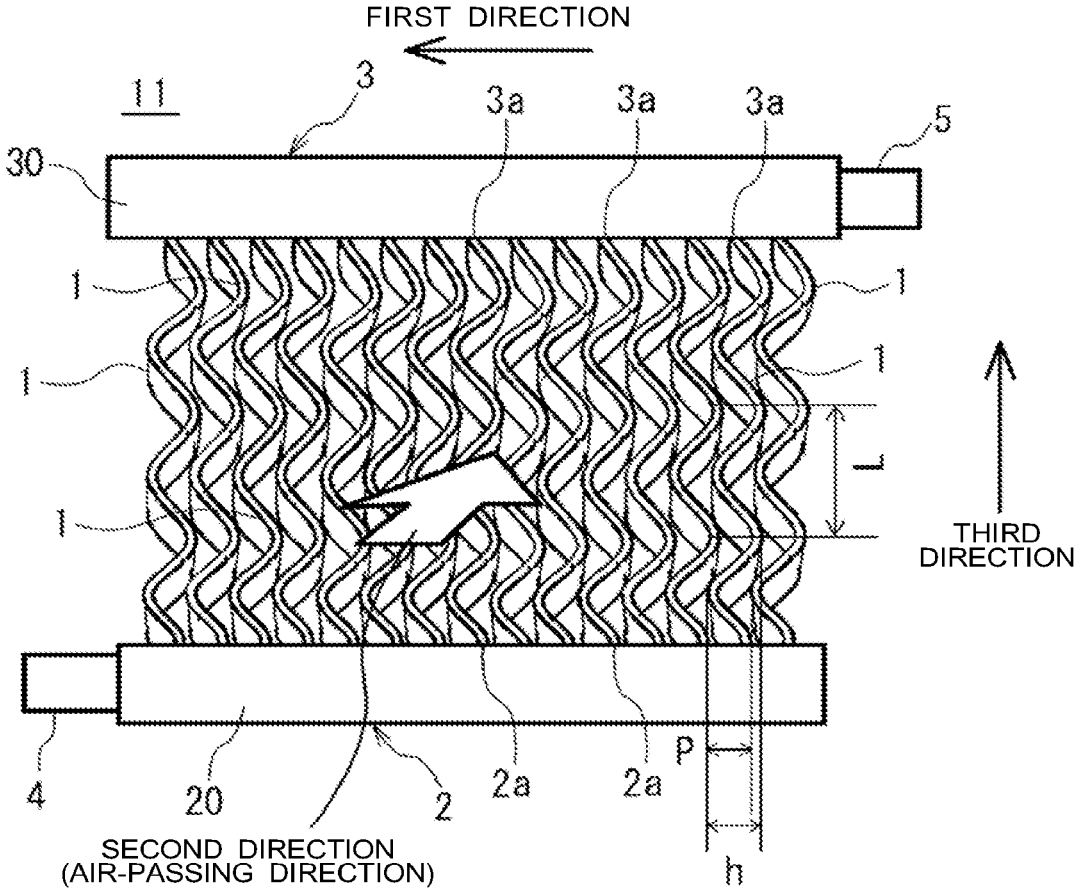
FIG. 5A is a front view for schematically illustrating a finless heat exchanger according to Embodiment 2 of the present invention.
Figure 5B:
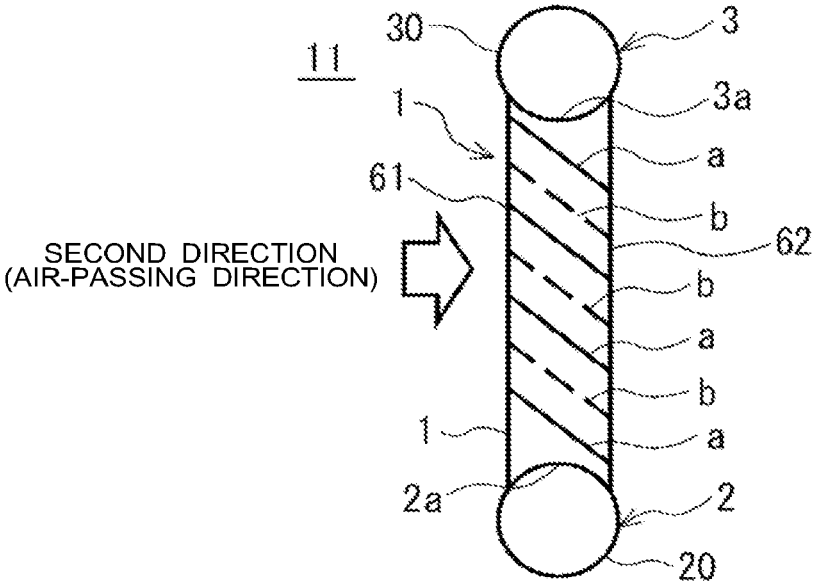
FIG. 5B is a side view of FIG. 5A.

Next, a finless heat exchanger according to Embodiment 2 of the present invention is described with reference to FIG. 5. In Embodiment 2, differences from Embodiment 1 are mainly described. The same parts are denoted by the same reference signs, and description of the parts is omitted. FIG. 5A is a front view for schematically illustrating the finless heat exchanger according to Embodiment 2 of the present invention. FIG. 5B is a side view of FIG. 5A.

As illustrated in FIG. 5A and FIG. 5B, a finless heat exchanger 11 according to Embodiment 2 has a configuration in which the flat pipes 1 are arrayed to be inclined so that the mountain fold lines "a" and the valley fold lines "b" of the wave shape are oriented obliquely downward to the horizontal direction. The mountain fold lines "a" and the valley fold lines "b" of the flat pipes 1 are oriented in an angular direction at about 30 degrees to the horizontal direction as an example.

In a case in which the finless heat exchanger 11 is used as an evaporator, the condensed water flows downward through the air flow gaps along the flat pipes 1 in the gravity direction while meandering, and part of the condensed water is separated from the flat pipes 1 and flows out to the front surface (windward side) and the back surface (leeward side) as viewed in the air-passing direction. As compared to the above-mentioned finless heat exchanger 10 according to Embodiment 1, the drainage performance is further enhanced.

In the finless heat exchanger 11, the mountain fold lines "a" and the valley fold lines "b" of the wave shape are oriented in the obliquely downward direction to the air-passing direction, and hence the condensed water is discharged to the leeward side. Further, although detailed illustration is omitted, in the case in which the flat pipes 1 are arrayed to be inclined so that the mountain fold lines "a" and the valley fold lines "b" of the wave shape are oriented obliquely upward to the air-passing direction, the condensed water is discharged to the windward side. Consequently, in the finless heat exchanger 11, the condensed water is less liable to flow downward to the lower part of the heat exchanger 11. Even when the condensed water flows downward, the condensed water does not accumulate and is easily discharged. As a result, also at the time of the defrosting operation after the operation causing frost formation, a defect such as accumulation of ice on the lower part of the heat exchanger 11 can further be prevented. The flat pipes 1 are formed into a shape having bent portions as in the triangular wave shape illustrated in FIG. 4. Thus, the condensed water easily flows downward along the corners of the mountain fold lines "a" and the valley fold lines "b". With this configuration, the finless heat exchanger 11 may suitably be formed.

Further, in the finless heat exchanger 11, the positions of the mountain fold lines "a" of each of the flat pipes 1 are the same in height in the first direction and the positions of the mountain fold lines "b" of each of the flat pipes 1 are the same in height in the first direction. Consequently, similarly to the case of the finless heat exchanger 10 according to Embodiment 1 illustrated in FIG. 2, a relationship of array pitch P amplitude h of wave shape is satisfied to increase the surface area, thereby the performance can be enhanced.

Further, unlike the finless heat exchanger 10 according to Embodiment 1, in the finless heat exchanger 11, the flat surfaces 60 having a wave shape can be seen in the air-passing direction (second direction). Consequently, the flat surfaces 60 serve as oblique surfaces against which air collides, and the heat exchange area can be increased substantially. In this respect, it is preferable in the wave shape that, when the wave shape parts are viewed from the air-passing direction (second direction), the proportion of the side surfaces 61 and the oblique flat surfaces 60 to the entire projection surface be 50% or more, and it is more preferable that the proportion be 80% or more.

Embodiment 3

Figure 6A:
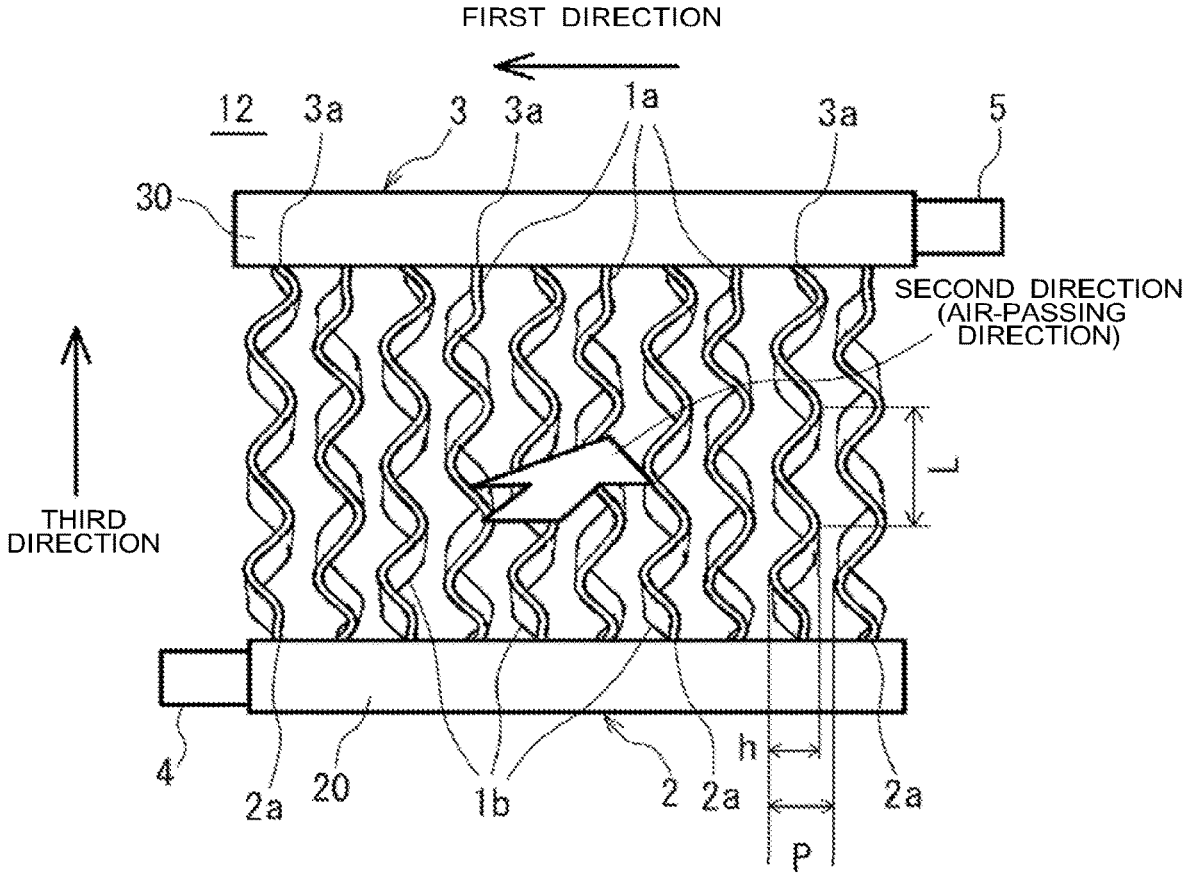
FIG. 6A is a front view for schematically illustrating a finless heat exchanger according to Embodiment 3 of the present invention.
Figure 6B:
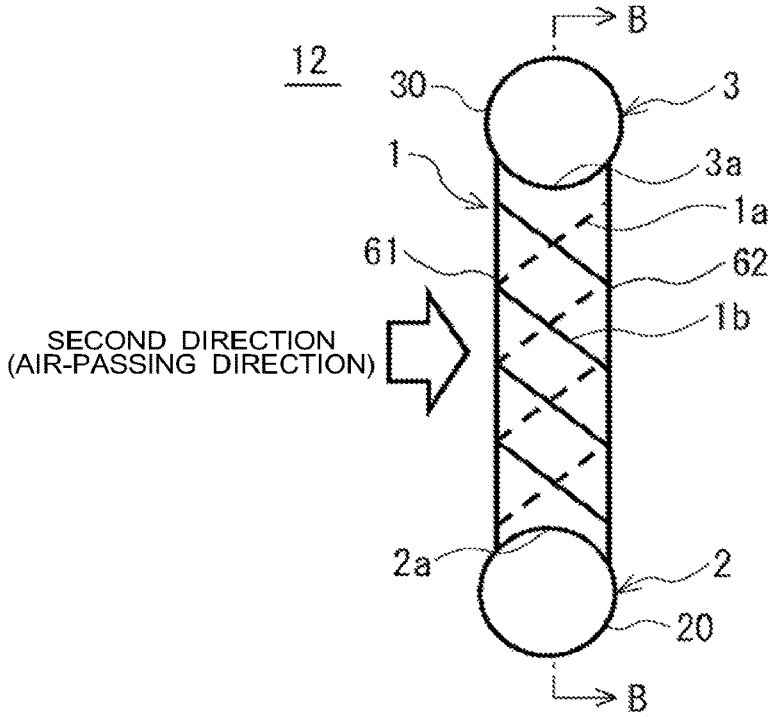
FIG. 6B is a side view of the finless heat exchanger illustrated in FIG. 6A.
Figure 6C:
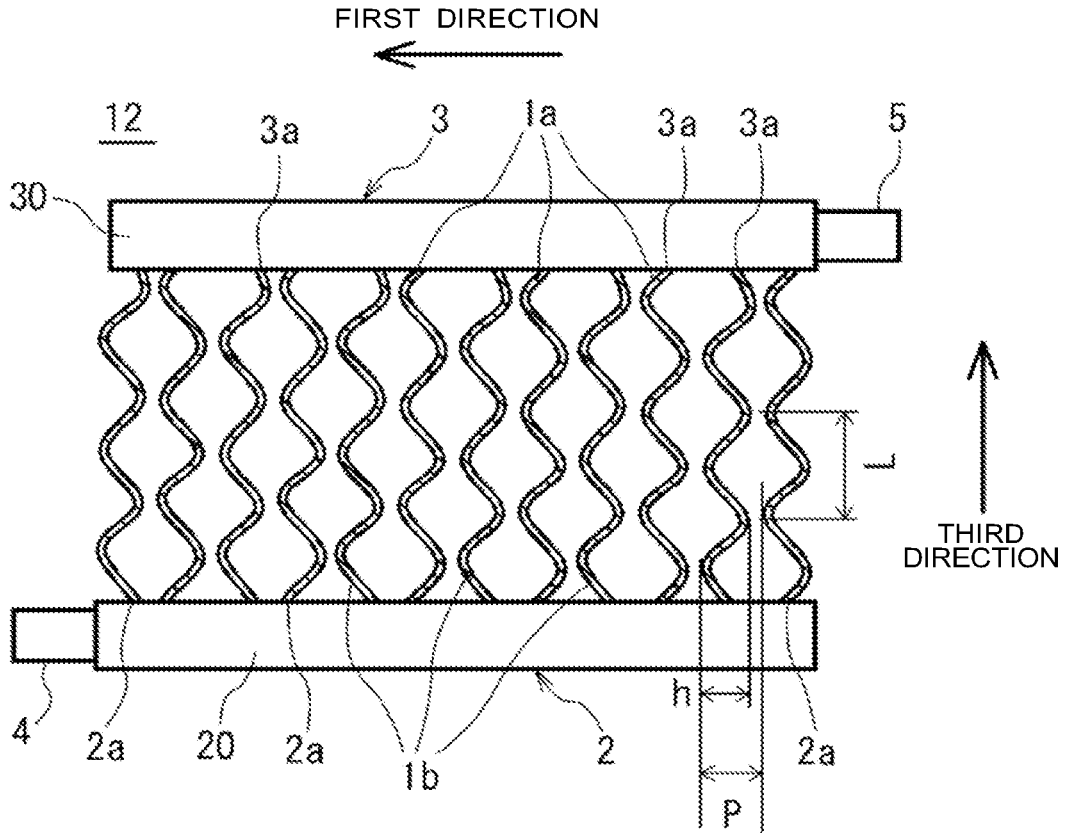
FIG. 6C is a sectional view of the flat pipes as viewed in a direction indicated by the arrows of the line B-B illustrated in FIG. 6B.

Next, a finless heat exchanger according to Embodiment 3 of the present invention is described with reference to FIG. 6. In Embodiment 3, differences from Embodiments 1 and 2 are mainly described. The same parts are denoted by the same reference signs, and description of the parts is omitted. FIG. 6A is a front view for schematically illustrating the finless heat exchanger according to Embodiment 3 of the present invention. FIG. 6B is a side view of the finless heat exchanger illustrated in FIG. 6A. FIG. 6C is a sectional view of the flat pipes as viewed in a direction indicated by the arrows of the line B-B illustrated in FIG. 6B.

A finless heat exchanger 12 according to Embodiment 3 has a configuration in which one of adjacent pair of flat pipes 1 of the plurality of flat pipes 1 is reversed to the first direction and the ones of the pairs are arrayed. Specifically, each of a plurality of flat pipes 1*a* in which the mountain fold lines "a" and the valley fold lines "b" of a wave shape are inclined to be oriented obliquely upward to the horizontal direction and each of a plurality of flat pipes 1*b* in which the mountain fold lines "a" and the valley fold lines "b" of a wave shape are oriented to be obliquely downward to the horizontal direction are alternately arrayed. That is, the mountain fold lines "a" and the valley fold lines "b" of the adjacent flat pipes 1 are inclined in different directions to the second direction.

Consequently, in the finless heat exchanger 12 according to Embodiment 3, in the air flow gap between the adjacent right and left flat pipes 1, air flowing on the flat pipe 1*a* side that is oriented obliquely upward, and air flowing on the flat pipe 1*b* side that is oriented obliquely downward, collide against each other and are stirred at an intermediate portion between the flat pipes 1*a* and 1*b* in the air-passing direction (at a halfway distance of the width W of the flat pipe from the leading edge). Consequently, the heat transfer characteristics are enhanced at this position and a slipstream part of the position. In this case, the array pitch P satisfies a relationship of P≥h. In the case in which a relationship of P=h is satisfied, the flat pipes 1*a* and 1*b* are held in contact with each other at the intermediate portion between the flat pipes 1*a* and 1*b* in the air-passing direction. However, the mountain fold lines "a" of the wave shape of the flat pipes 1*a* and 1*b* are inclined in the oblique direction to the horizontal direction. Consequently, the condensed water does not accumulate. Further, as the array pitch P is increased to be larger than the amplitude h, a gap is secured also at the intermediate portion between the flat pipes 1*a* and 1*b*. Thus, the drainage performance for the condensed water is enhanced.

Embodiment 4

Next, a finless heat exchanger according to Embodiment 4 of the present invention is described with reference to FIG. 7 and FIG. 8. In Embodiment 4, differences from Embodiments 1 to 3 are mainly described. The same parts are denoted by the same reference signs, and description of the parts is omitted.

Figure 7A:
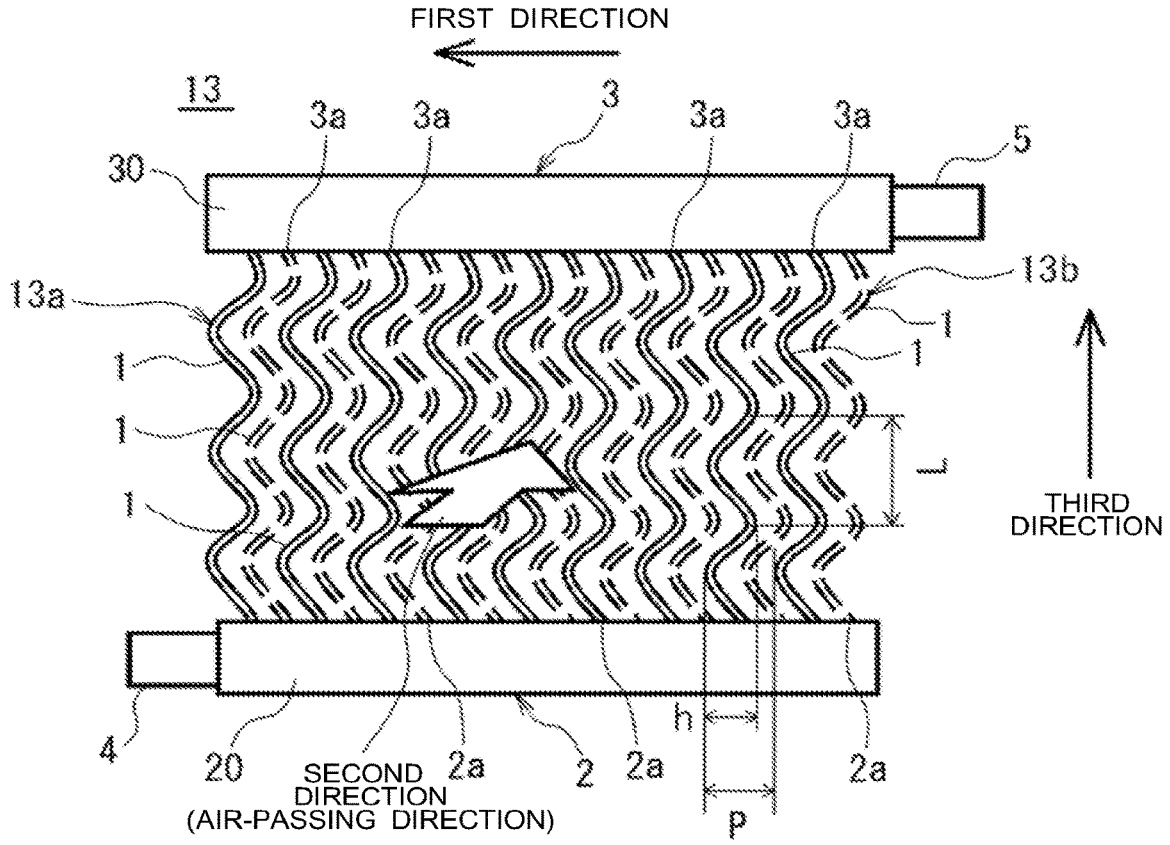
FIG. 7A is a front view for schematically illustrating a finless heat exchanger according to Embodiment 4 of the present invention.
Figure 7B:
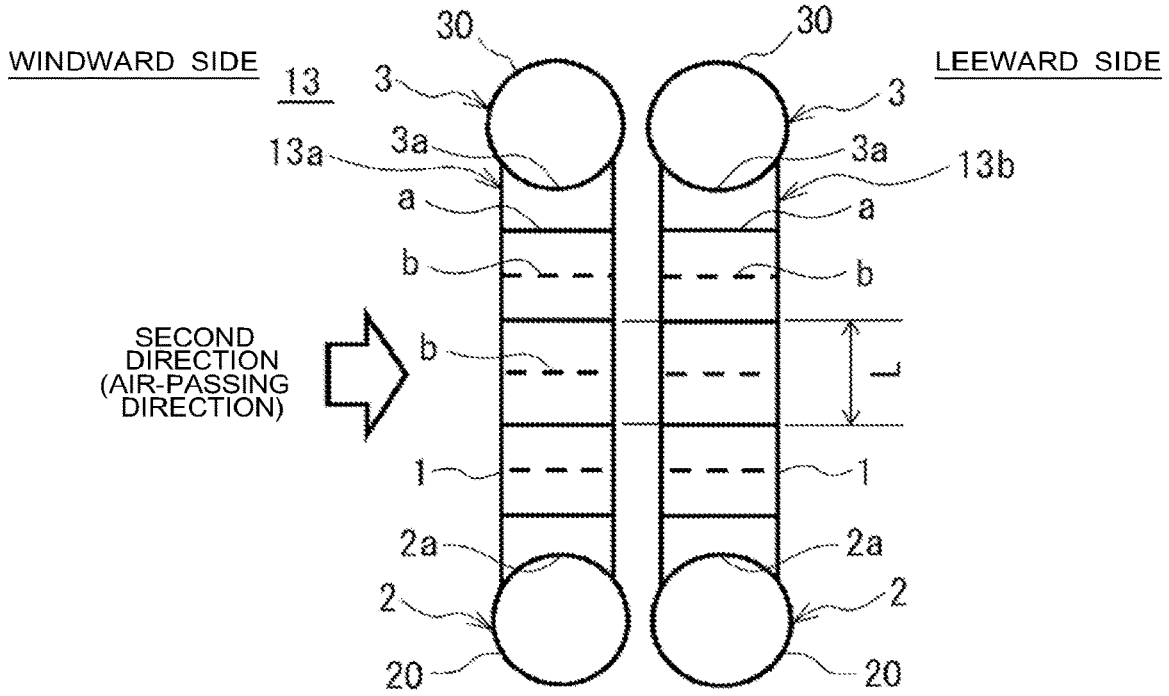
FIG. 7B is a side view of the finless heat exchanger illustrated in FIG. 7A.

FIG. 7A is a front view for schematically illustrating the finless heat exchanger according to Embodiment 4 of the present invention. FIG. 7B is a side view of the finless heat exchanger illustrated in FIG. 7A. A finless heat exchanger 13 illustrated in FIG. 7A and FIG. 7B has a configuration in which two of the finless heat exchangers 10 described above in Embodiment 1 are arrayed in the second direction. In the finless heat exchanger 13, flat pipes 1 of a heat exchanger 13*b* placed on the leeward side are arrayed to be shifted by a half pitch (P/2) to flat pipes 1 of a heat exchanger 13*a* placed on the windward side. That is, in the finless heat exchanger 13, the flat pipes 1 of the heat exchanger 13*b* on the leeward side are arrayed just between the flat pipes 1 of the heat exchanger 13*a* on the windward side. Consequently, the flat pipes 1 of the heat exchanger 13*b* on the leeward side are less liable to be affected by a slipstream of the windward side. Thus, the leading edge effect can be obtained also on the downstream side, thereby the heat transfer characteristics are enhanced.

Although detailed illustration is omitted, the finless heat exchanger 13 may be formed with a configuration in which two of the heat exchangers 11 described above in Embodiment 2 are arrayed in the second direction instead of the heat exchangers 10 described above in Embodiment 1, or a configuration in which two of the heat exchangers 12 described above in Embodiment 3 are arrayed in the second direction instead of the heat exchangers 10 described above in Embodiment 1. The drainage performance can be enhanced by such configurations.

Figure 7C:
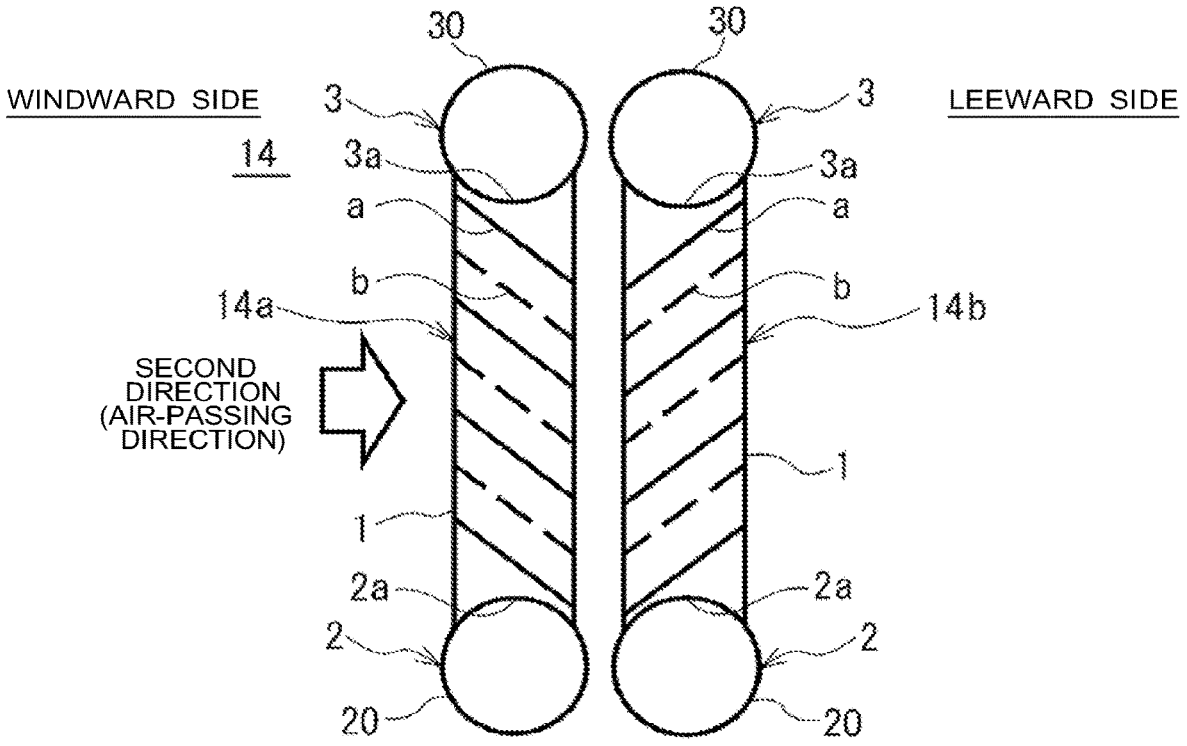
FIG. 7C is a side view for schematically illustrating another configuration of the finless heat exchanger according to Embodiment 4 of the present invention.

FIG. 7C is a side view for schematically illustrating another configuration of the finless heat exchanger according to Embodiment 4 of the present invention. A finless heat exchanger 14 illustrated in FIG. 7C has a configuration in which the mountain fold lines "a" and the valley fold lines "b" of flat pipes 1 of a heat exchanger 14*a* placed on the windward side in the second direction are oriented obliquely downward to the horizontal direction, and the mountain fold lines "a" and the valley fold lines "b" of flat pipes 1 of a heat exchanger 14*b* placed on the leeward side are oriented obliquely upward to the horizontal direction. In the finless heat exchanger 14, at the time when air flowing along the flat pipes 1 on the windward side flows into spaces defined by the flat pipes 1 on the leeward side, the air collides at the leading edge part of the flat pipes 1 on the leeward side to be disturbed and stirred. Thus, the heat transfer characteristics can be enhanced in the flat pipes 1 on the leeward side.

As in the finless heat exchanger 13 described with reference to FIG. 7A and FIG. 7B, the finless heat exchanger 14 may also be formed with a configuration in which the flat pipes 1 of the heat exchanger 14*b* placed on the leeward side are arrayed to be shifted by a half pitch (P/2) to the flat pipes 1 of the heat exchanger 14*a* placed on the windward side.

Figure 7D:
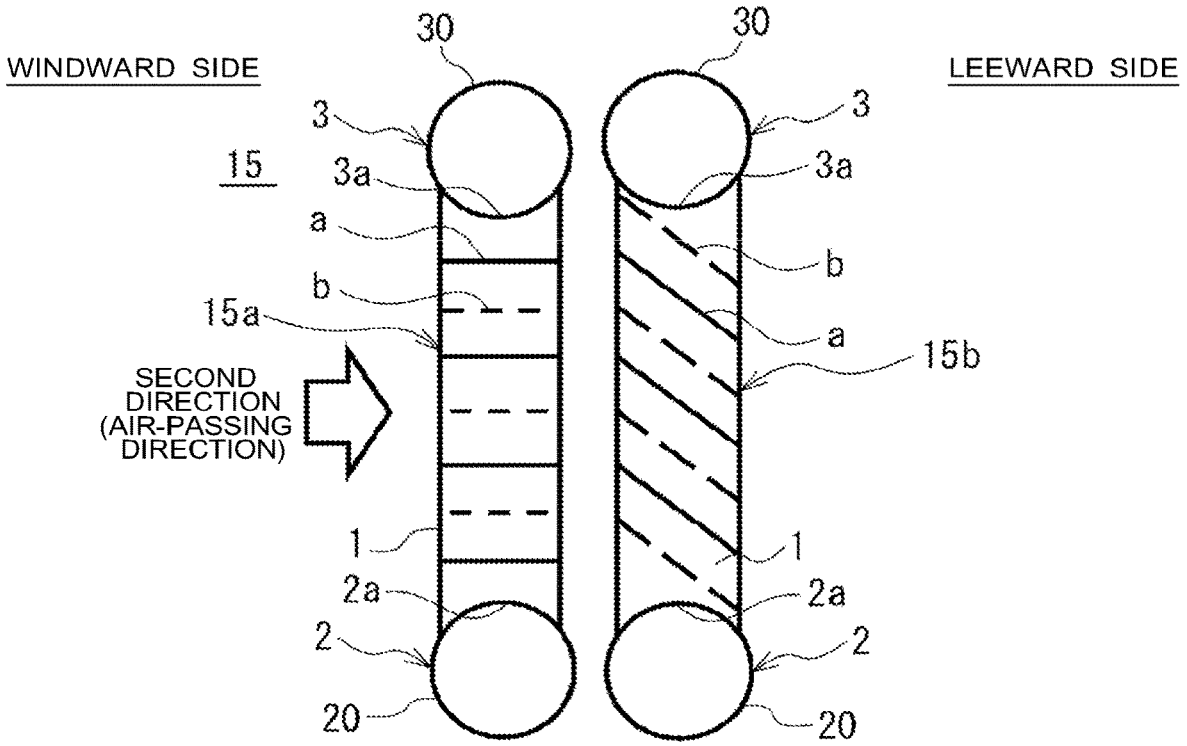
FIG. 7D is a side view for schematically illustrating another configuration of the finless heat exchanger according to Embodiment 4 of the present invention.

FIG. 7D is a side view for schematically illustrating another configuration of the finless heat exchanger according to Embodiment 4 of the present invention. A finless heat exchanger 15 illustrated in FIG. 7D has a configuration in which the finless heat exchanger 10 described above in Embodiment 1 is provided as a heat exchanger 15*a* placed on the windward side, and the finless heat exchanger 11 described above in Embodiment 2 is provided as a heat exchanger 15*b* placed on the leeward side so that the two of the heat exchangers are arrayed in the second direction. When the finless heat exchanger 15 is formed with a configuration in which the heat exchanger 11 described above in Embodiment 2 is placed on the windward side, and the heat exchanger 10 described above in Embodiment 1 is placed on the leeward side, a flow of the air can be adjusted in the air-passing direction, and the air can be caused to flow out from the outdoor unit. Further, as in the finless heat exchanger 13 described with reference to FIG. 7A and FIG. 7B, the finless heat exchanger 15 may also be formed with a configuration in which the flat pipes 1 of the heat exchanger 15*b* placed on the leeward side are arrayed to be shifted by a half pitch (P/2) to the flat pipes 1 of the heat exchanger 15*a* placed on the windward side.

Figure 8A:
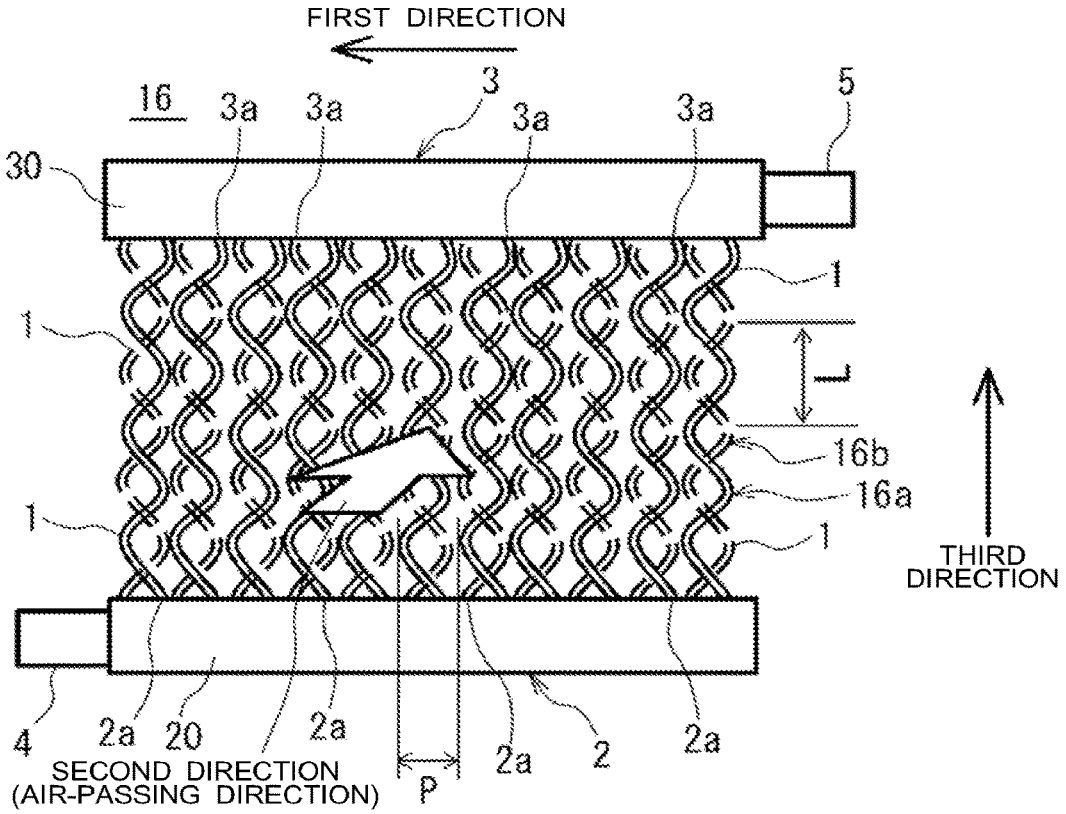
FIG. 8A is a front view for schematically illustrating another configuration of the finless heat exchanger according to Embodiment 4 of the present invention.
Figure 8B:
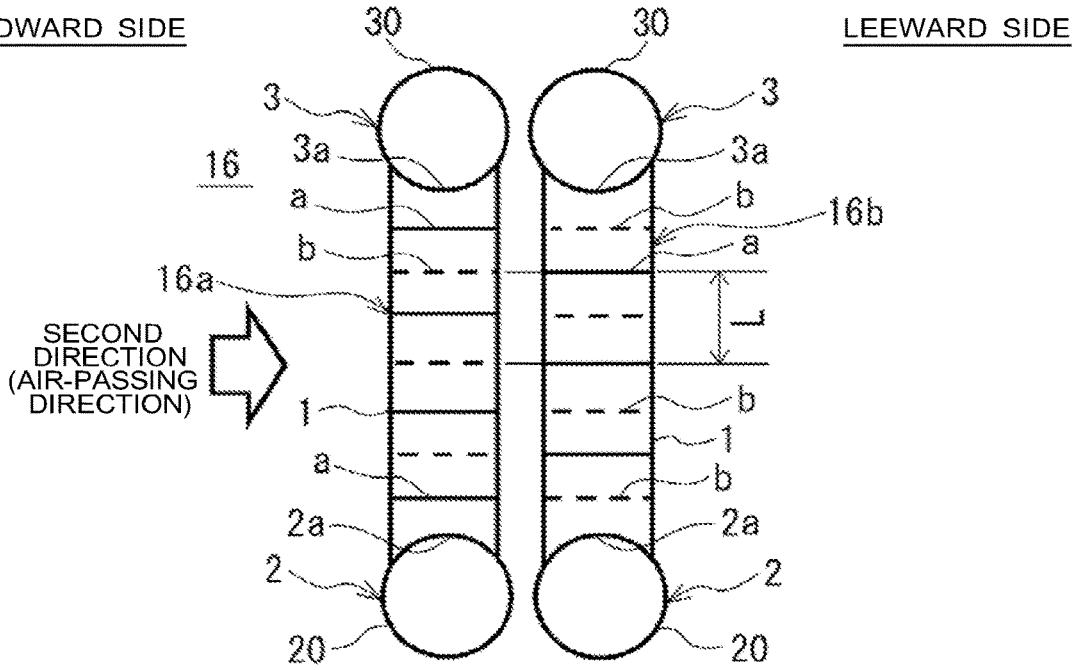
FIG. 8B is a side view of FIG. 8A.

FIG. 8A is a side view for schematically illustrating another configuration of the finless heat exchanger according to Embodiment 4 of the present invention. FIG. 8B is a side view of FIG. 8A. In a finless heat exchanger 16 illustrated in FIG. 8A and FIG. 8B, a heat exchanger 16*a* on the windward side and a heat exchanger 16*b* on the leeward side are each the finless heat exchanger 10 described above in Embodiment 1. Flat pipes 1 of the heat exchanger 16*b* placed on the leeward side are arrayed to be reversed in the right-and-left direction so that phases are shifted by 180 degrees to flat pipes 1 of the heat exchanger 16*a* placed on the windward side. The finless heat exchanger 16 may also be formed with a configuration in which the heat exchanger 16*a* on the windward side and the heat exchanger 16*b* on the leeward side are each the finless heat exchanger 11 described above in Embodiment 2.

Further, although detailed illustration is omitted, the finless heat exchanger 16 may be formed with a configuration in which the heat exchanger on the windward side and the heat exchanger on the leeward side are each the finless heat exchanger 11 described above in Embodiment 2, and the flat pipes of the heat exchanger placed on the leeward side are arrayed to be reversed to the third direction. In short, the finless heat exchanger according to Embodiment 4 is not limited to the modes illustrated in the drawings, and may be formed with various modes by combining the heat exchangers described above.

In Embodiment 4, the configuration in which the two of the finless heat exchangers are arrayed in the second direction is illustrated. However, there may be employed a configuration in which three or four finless heat exchangers are arrayed in the second direction. In consideration that the finless heat exchangers are to be mounted to the outdoor unit or the indoor unit of the air-conditioning apparatus, it is desired that the finless heat exchangers be arrayed in four rows or less in the second direction.

Embodiment 5

Figure 9A:
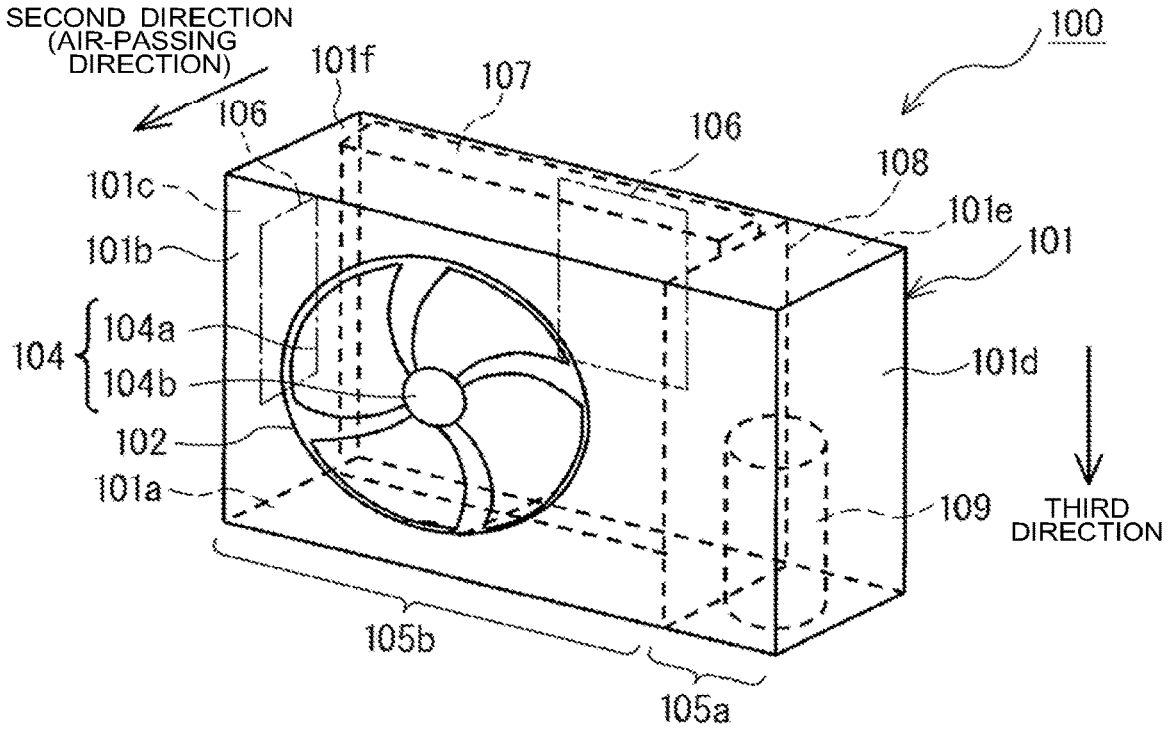
FIG. 9A is a perspective view for schematically illustrating an outdoor unit of an air-conditioning apparatus that includes the finless heat exchanger according to the present invention.
Figure 9B:
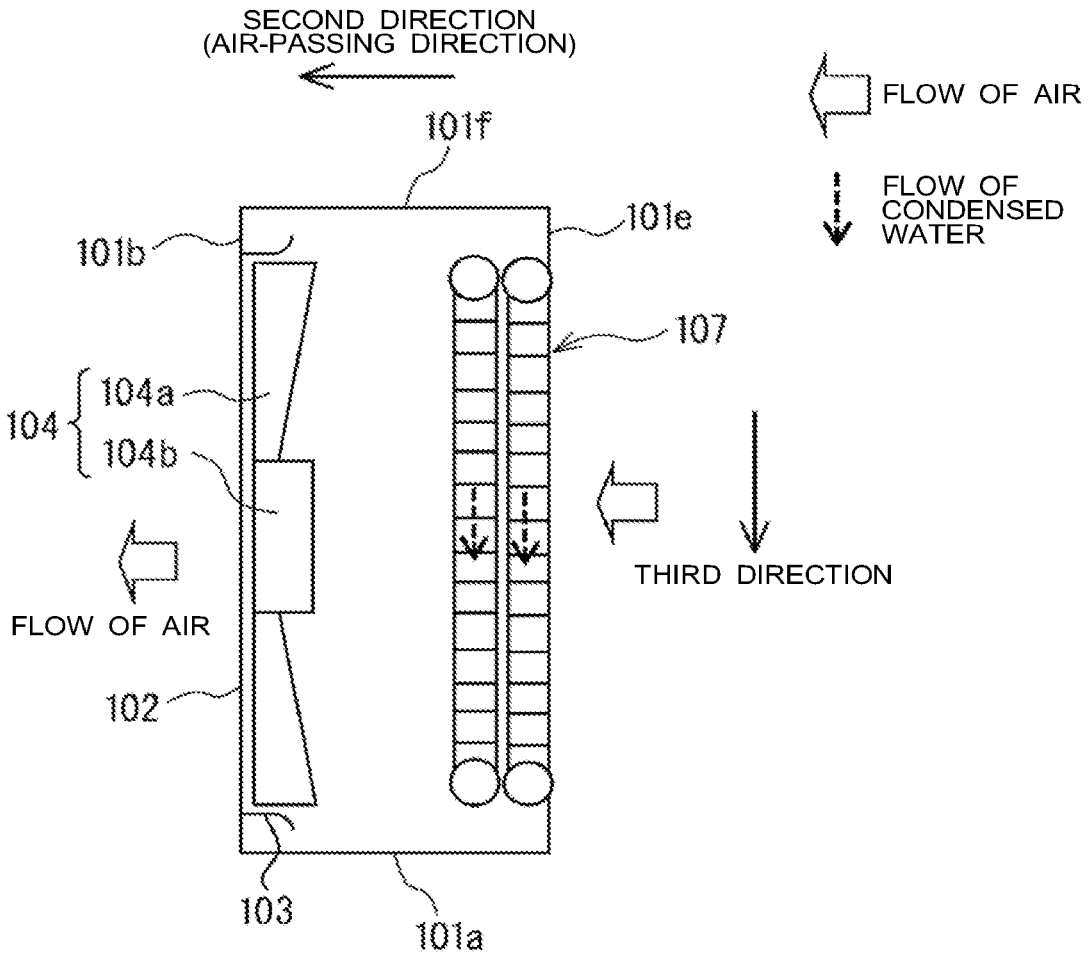
FIG. 9B is a schematic view for illustrating the internal structure of the outdoor unit illustrated in FIG. 9A.

Next, an outdoor unit of the air-conditioning apparatus that includes the finless heat exchanger according to the present invention is described with reference to FIG. 9. FIG. 9A is a perspective view for schematically illustrating the outdoor unit of the air-conditioning apparatus that includes the finless heat exchanger according to the present invention. FIG. 9B is a schematic view for illustrating the internal structure of the outdoor unit illustrated in FIG. 9A. In FIG. 9, a dimensional relationship of components and a shape of each of the components may be different from those of actual components. Further, positional relationships (for example, top-bottom relationships) of components herein are, in principle, relationships exhibited when the outdoor unit is installed in a usable state.

An outdoor unit 100 illustrated in FIG. 9A and FIG. 9B is an outdoor unit of a side-flow type in which an air-sending device 104 and a heat exchanger 107 are arranged in parallel in the horizontal direction to cause air to flow through. As illustrated in FIG. 9A, the outdoor unit 100 includes a casing 101 including a base panel 101*a*, a front panel 101*b*, side panels 101*c* and 101*d*, a rear panel 101*e*, and a top panel 101*f*. An air outlet 102 is formed in the front panel 101*b*. Further, an air inlet 106 is formed in each of the side panel 101*c*, which is one of the side panels 101*c* and 101*d*, and the rear panel 101*e*.

The air-sending device 104 is mounted to the air outlet 102 by a stay (not shown). The air-sending device 104 includes a boss 104*b*, a plurality of blades 104*a* provided on an outer peripheral portion of the boss 104*b*, and a fan motor (not shown) configured to rotate the boss 104*b* and the blades 104*a* about the center of the boss 104*b* as a rotation axis. A bellmouth 103 is provided on the air outlet 102 to surround the outer peripheral portion of the air-sending device 104. Inside the casing 101, the heat exchanger 107 and a compressor 109 are fixed to an upper surface of the base panel 101*a*. The inside of the casing 101 is partitioned by a partition plate 108 into a machine chamber 105*a* in which the compressor 109 is mounted and an air passage chamber 105*b* accommodating the heat exchanger 107 and the air-sending device 104. In this case, the heat exchanger 107 is any one of the finless heat exchangers 13 to 16 described in Embodiment 4, and, as illustrated in FIG. 9B, the heat exchangers are arranged in two rows in the second direction so that the third direction substantially corresponds to the gravity direction. Although detailed illustration is omitted, the heat exchanger 107 may have a configuration in which any one of the finless heat exchangers 10 to 12 described in Embodiment 1 to 3 is placed.

Next, an operation of the outdoor unit 100 is described. The flow of the air is indicated by the outlined arrows in FIG. 9B. The air flow generated by the air-sending device 104 flows in through air flow gaps each between the flat pipe and the flat pipe of the heat exchanger 107, passes through the air passage defined by the heat exchanger 107, the side panels 101*c*, the front panel 101*b*, the rear panel 101*e*, and the partition plate 108, and is blown out through the air outlet 102. During this operation, the air is subjected to heat exchange with the refrigerant by the heat exchanger 107. Further, in a case in which the heat exchanger 107 is operated as an evaporator, condensed water generated during a heating operation or condensed water generated during a defrosting operation performed in the case of formation of frost flows downward along the flat pipes as indicated by the broken line arrows, and is drained.

As described above, in the outdoor unit 100 illustrated in FIG. 9A and FIG. 9B, the suction area of the heat exchanger 107 is sufficiently secured, and the heat exchangers are provided in two rows in the flow direction. Further, the extending direction of the flat pipes (third direction) substantially corresponds to the gravity direction. Consequently, in the outdoor unit 100, high drainage performance for the condensed water can be secured, and, in addition, the high heat exchange performance, the power for the air-sending device 104, and reduction in noise of the air-sending device 104 can be balanced.

Embodiment 6

Figure 10A:
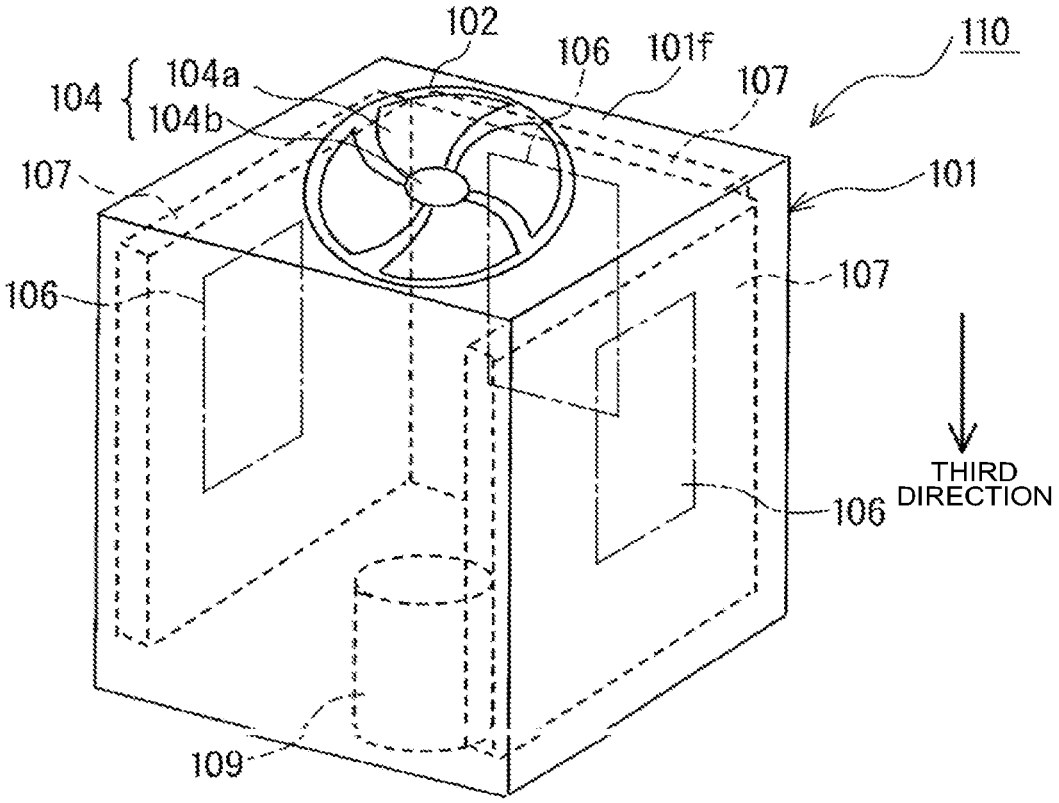
FIG. 10A is a perspective view for schematically illustrating another mode of the outdoor unit of an air-conditioning apparatus that includes the finless heat exchanger according to the present invention.
Figure 10B:
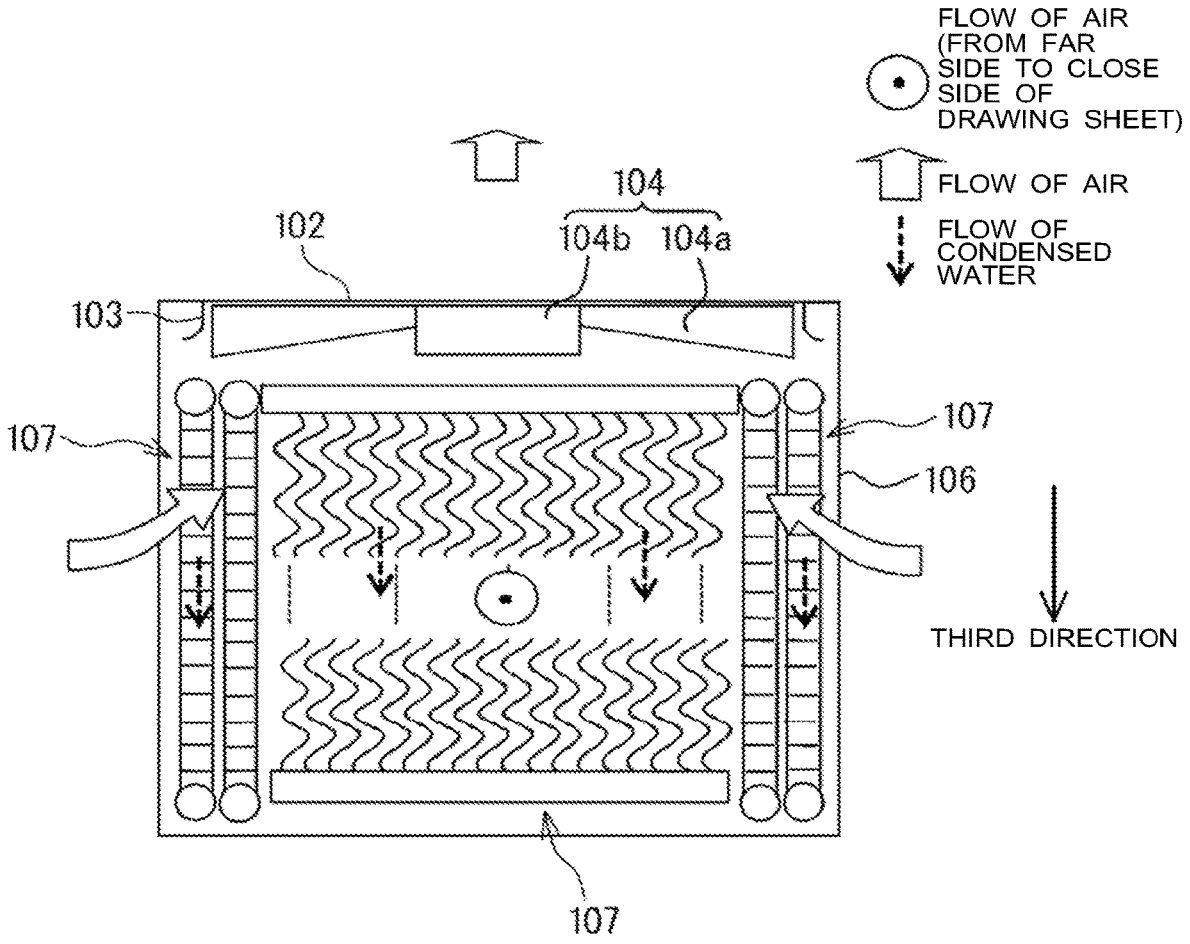
FIG. 10B is a schematic view for illustrating the internal structure of the outdoor unit illustrated in FIG. 10A.

Next, another mode of the outdoor unit of the air-conditioning apparatus that includes the finless heat exchanger according to the present invention is described with reference to FIG. 10. FIG. 10A is a perspective view for schematically illustrating the other mode of the outdoor unit of the air-conditioning apparatus that includes the finless heat exchanger according to the present invention. FIG. 10B is a schematic view for illustrating the internal structure of the outdoor unit illustrated in FIG. 10A. The parts in the same configurations as those of the outdoor unit of the air-conditioning apparatus described in Embodiment 5 are denoted by the same reference signs, and description of the configurations is omitted as appropriate. Further, in FIG. 10A and FIG. 10B, a dimensional relationship of components and a shape of each of the components may be different from those of actual components. Further, positional relationships (for example, top-bottom relationships) between components herein are, in principle, relationships exhibited when the outdoor unit is installed in a usable state.

An outdoor unit 110 illustrated in FIG. 10 is an outdoor unit of a top-flow type in which the air-sending device 104 and the heat exchanger 107 are arranged in parallel in the up-and-down direction to cause air to flow through. As illustrated in FIG. 10A, the casing 101 has the air outlet 102 formed in the top panel 101*f*. An axial fan serving as the air-sending device 104 is mounted to the air outlet 102. Further, the air inlet 106 is each formed in three side surfaces of the casing 101. The heat exchanger 107 is placed along the side surfaces of the casing 101 in which the air inlets 106 are formed. In this case, the heat exchanger 107 is any one of the finless heat exchangers 13 to 16 described in Embodiment 4, and, as illustrated in FIG. 10B, the heat exchangers are arranged in two rows in the air-passing direction so that the extending direction (third direction) substantially corresponds to the gravity direction. Although detailed illustration is omitted, the heat exchanger 107 may have the configuration in which any one of the finless heat exchangers 10 to 12 described in Embodiment 1 to 3 is placed.

Next, an operation of the outdoor unit 110 is described. The flow of the air is indicated by the outlined arrows in FIG. 10B. After the air flows in through the air inlets 106 formed in the three side surfaces, the flow of the air is turned so that the air passes through the heat exchanger 107, and the air is discharged through the air-sending device 104. During this operation, the air is subjected to heat exchange with the refrigerant by the heat exchanger 107. Further, in the case in which the heat exchanger 107 is operated as an evaporator, the condensed water generated during the heating operation or the condensed water generated during the defrosting operation performed in the case of formation of frost flows downward along the flat pipes as indicated by the broken line arrows, and is drained.

In the outdoor unit 110 having the above-mentioned configuration, similarly to the outdoor unit 100 illustrated in FIG. 9, the suction area of the heat exchanger 107 is sufficiently secured, and the heat exchangers are provided in about two rows in the flow direction. Further, the extending direction of the flat pipes (third direction) substantially corresponds to the gravity direction. Consequently, in the outdoor unit 110, high drainage performance for the condensed water can be secured, and, in addition, the high heat exchange performance, the power for the air-sending device 104, and reduction in noise of the air-sending device 104 can be balanced.

Embodiment 7

Figure 11:
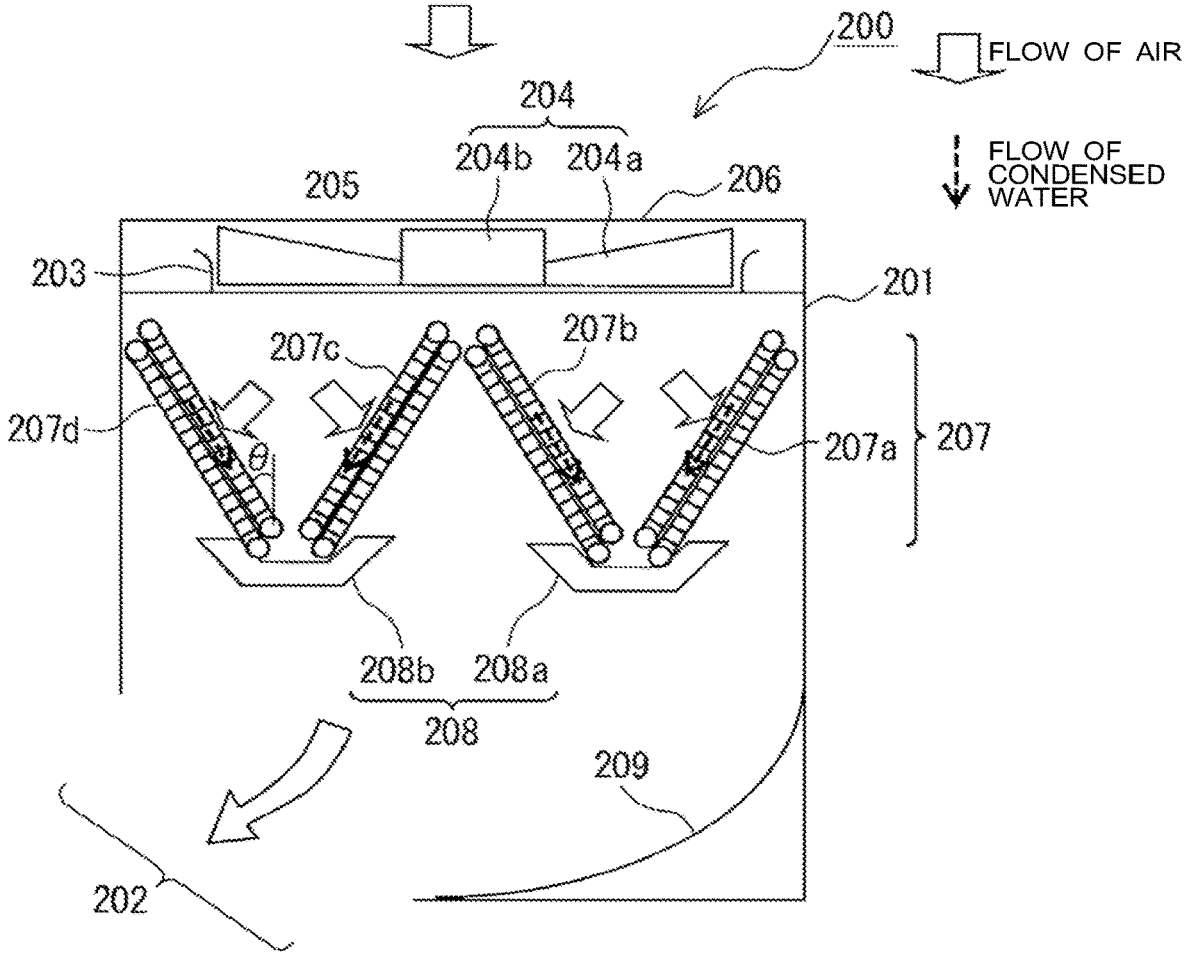
FIG. 11 is a schematic view for illustrating the internal structure of an indoor unit of an air-conditioning apparatus that includes the finless heat exchanger according to the present invention.

Next, an indoor unit of an air-conditioning apparatus that includes the finless heat exchanger according to the present invention is described with reference to FIG. 11. FIG. 11 is a schematic view for illustrating the internal structure of the indoor unit of the air-conditioning apparatus that includes the finless heat exchanger according to the present invention.

An indoor unit 200 illustrated FIG. 11 is exemplified as a wall-mounting type. The flow of the air is indicated by the outlined arrows. Further, the left side in FIG. 11 corresponds to the front surface side (indoor side) of the indoor unit. In FIG. 11, a dimensional relationship of components and a shape of each of the components may be different from those of actual components. Further, positional relationships (for example, top-bottom relationships) between components herein are, in principle, relationships exhibited when the indoor unit is installed in a usable state.

As illustrated in FIG. 11, the indoor unit 200 of the air-conditioning apparatus includes a casing 201 having a box shape. Inside the casing 201, there are provided an air-sending device 204, a heat exchanger 207 (indoor heat exchanger), and a drain pan 208.

In the casing 201, there are formed an air inlet 206 for sucking air from an inside of a room, and an air outlet 202 for blowing out the air to the inside of the room. The air inlet 206 is formed in the upper part of the casing 201 (upper surface). The air outlet 202 is formed in the lower part of the front surface of the casing 201. In the casing 201, there is provided an air guide wall 209 configured to guide air that is sucked through the air inlet 206 and flows through the air-sending device 204, the heat exchanger 207 (indoor heat exchanger), and the drain pan 208 to the air outlet 202.

The air-sending device 204 is provided on the upper part of the casing 201, that is, in the vicinity of the air inlet 206. A bellmouth 203 is provided in the air inlet 206 to surround an outer peripheral portion of the air-sending device 204. Through drive of the air-sending device 204, an air passage is formed in the casing 201. In the air passage, air flowing in through the air inlet 206 in the upper part of the casing 201 passes through the heat exchanger 207, and flows out through the air outlet 202 in the lower part of the casing 201.

The air-sending device 204 is an axial fan. The air-sending device 204 includes a boss 204*b*, a plurality of blades 204*a* provided on an outer peripheral portion of the boss 204*b*, and a fan motor (not shown) configured to rotate the boss 204*b* and the blades 204*a* about the center of the boss 204*b* as a rotation axis. In FIG. 11, only one air-sending device 204 is illustrated. However, a plurality of air-sending devices 204 may be arrayed, for example, in a direction orthogonal to the drawing sheet of FIG. 11.

On a downstream side of the air-sending device 204, the heat exchanger 207 including four blocks 207*a*, 207*b*, 207*c*, and 207 is placed. The heat exchanger 207 is placed in a zigzag shape (W shape) such that the four blocks 207*a* to 207*d* are arrayed in the horizontal direction sequentially from the back surface side toward the front surface side of the indoor unit 200. In this case, each of the blocks 207*a* to 207*d* forming the heat exchanger 207 is any one of the finless heat exchangers 13 to 16 described in Embodiment 4. In each of the blocks 207*a* to 207*d*, the heat exchangers are arranged in two rows in the second direction such that the pipe passage direction is inclined to the gravity direction. An inclination angle θ of each of the blocks 207*a* to 207*d* is about 20 degrees to the gravity direction as an example. The inclination angle θ only needs to be an angle that allows condensed water to flow downward along the extending direction of the flat pipes and to be within a range of from 0 degrees or more to 45 degrees or less to the gravity direction. Although detailed illustration is omitted, the heat exchanger 207 may have a configuration in which any one of the finless heat exchangers 10 to 12 described in Embodiment 1 to 3 is placed.

Next, an operation of the indoor unit 200 is described. As illustrated in FIG. 11, the air is caused to flow in through the air inlet 206 formed in the back surface by the air-sending device 204, passes through the heat exchanger 207, and is blown out through the air outlet 202. When the air passes through the heat exchanger 207, the air is subjected to heat exchange. In a case in which the indoor unit is operated as an evaporator, condensed water generated during a heating operation or condensed water generated during a defrosting operation performed in the case of formation of frost flows downward along the flat pipes as indicated by the broken line arrows, and is drained.

As described above, in the indoor unit 200 illustrated in FIG. 11, the suction area of the heat exchanger 207 is sufficiently secured, the heat exchangers are provided in about two rows in the flow direction, and further, the extending direction of the flat pipes (third direction) substantially corresponds to the gravity direction. Consequently, in the indoor unit 200, high drainage performance for the condensed water can be secured, and, in addition, the high heat exchange performance, the power for the air-sending device 204, and reduction in noise of the air-sending device 204 can be balanced.

In the indoor unit 200 illustrated in FIG. 11, the side surface 62 on the leeward side, which less easily receives air by the air-sending device 204, corresponds to the lower side. Consequently, in the indoor unit 200, the condensed water flows downward mainly along the side surface 62 on the leeward side, thereby such a situation can be prevented that the condensed water is scattered due to the air by the air-sending device 204.

The indoor unit 200 illustrated in FIG. 11 is described by exemplifying the configuration in which the heat exchanger 207 includes the four blocks 207*a* to 207*d*. However, the heat exchanger 207 may include blocks of any number from two to more.

Further, the indoor unit 200 illustrated in FIG. 11 is described by exemplifying the configuration in which the axial fan is used as the air-sending device 204. However, there may be employed a configuration using a cross-flow fan. In the case of using the cross-flow fan as the air-sending device 204, the heat exchanger 207 and the air-sending device 204 may be arranged in the stated order along the flow of the air. Also with such a configuration, the same effects as those described above can be obtained.

The present invention has been described with reference to the embodiments, but the present invention is not limited to the configurations of the embodiments described above. For example, the internal configurations of the outdoor units 100 and 110 and the indoor unit 200 illustrated in the drawings are merely examples, and are not limited to the above description. Even an outdoor unit and an indoor unit including other components may similarly be applied. In short, just to make sure, it is noted that various changes, applications, and utilization ranges adopted by a person skilled in the art as required are also included in the gist (technical scope) of the present invention.

REFERENCE SIGNS LIST

1 flat pipe 1*a* flat pipe 1*b* flat pipe 2 inlet header 2*a*, 3*a* branching portion 3 outlet header 4, 5 refrigerant connecting pipe 6 passage 6*a* partition 10 to 16 finless heat exchanger 13*a* to 16*a* finless heat exchanger 13*b* to 16*b* finless heat exchanger 20, 30 pipe-shaped portion 33 compressor 34 condensing heat exchanger 35 expansion device 36 evaporating heat exchanger 37 air-sending device 38 air-sending device 60 flat surface 61, 62 side surface a mountain fold line b valley fold line

100 outdoor unit 101 casing 101*a* base panel 101*b* front panel 101*c*, 101*d* side panel 101*e* rear panel 101*f* top panel 102 air outlet 103 bellmouth 104 air-sending device 104*a* blade 104*b* boss 105*a* machine chamber 105*b* air passage chamber 106 air inlet 107 heat exchanger 108 partition plate 109 compressor 110 outdoor unit 200 indoor unit 201 casing 202 air outlet 203 bellmouth 204 air-sending device 204*a* blade 204*b* boss 206 air inlet 207 heat exchanger

207*a* to 207*d* block 208 drain pan 209 air guide wall

The invention claimed is:

1. A finless heat exchanger, comprising:

a pair of headers each including a pipe-shaped portion extending in a first direction, and a plurality of branching portions formed on the pipe-shaped portion at a predetermined interval in the first direction; and a pipe group including a plurality of flat pipes each having a flat sectional shape elongated in one direction, the plurality of flat pipes being arrayed in the first direction and connecting between the plurality of branching portions of one of the pair of headers and the plurality of branching portions of an other of the pair of headers, the finless heat exchanger having at least one passage structure in which a flat surface of one of adjacent two flat pipes and a flat surface of an other of the adjacent two flat pipes of the plurality of flat pipes of the pipe group face each other and in which the adjacent two flat pipes of the plurality of flat pipes of the pipe group each have a side surface facing a second direction orthogonal to the first direction, the finless heat exchanger being configured to exchange heat between air flowing through spaces defined by the plurality of flat pipes and refrigerant while the refrigerant is supplied from one of the pair of headers to the plurality of flat pipes to flow to an other of the pair of headers, the plurality of flat pipes being each bent in a wave shape and connect between the plurality of branching portions of the one and the other of the pair of headers, and the side surface of each of the plurality of flat pipes having a wave shape as viewed in the second direction, each of the flat surfaces of the plurality of flat pipes having corrugations in a wave shape with mountain fold lines and valley fold lines of the wave shape that continues from a side corresponding to one side surface to a side corresponding to an other side surface in a width direction, the mountain fold lines and the valley fold lines of the wave shape of each of the plurality of flat pipes being inclined in an oblique direction to a horizontal direction, the mountain fold lines and the valley fold lines of the wave shape of each of the plurality of flat pipes being aligned in height with the mountain fold lines and the valley fold lines of a flat pipe of the plurality of flat pipes that is adjacent, the plurality of flat pipes of the pipe group that are adjacent to each other being prevented from being held in contact with each other, both the side surfaces being opened so that the air flows in from the side corresponding to the one side surface in the second direction and flows out from the side corresponding to the other side surface in the second direction.

2. The finless heat exchanger of claim 1, wherein the first direction is the horizontal direction, and wherein the pair of headers are arranged at positions that are different from each other in height.

3. The finless heat exchanger of claim 1, wherein the plurality of flat pipes each accommodate a plurality of passages.

4. The finless heat exchanger of claim 1, wherein the at least one passage structure comprises two passage structures, and wherein the two passage structures are arranged in parallel in four rows or less in the second direction.

5. The finless heat exchanger of claim 4, wherein flat pipes of the plurality of flat pipes of one passage structure of the two passage structures arranged in parallel in the second direction are arrayed with a shift in pitch to flat pipes of the plurality of flat pipes of an other passage structure of the two passage structures.

6. The finless heat exchanger of claim 4, wherein flat pipes of the plurality of flat pipes of one passage structure of the two passage structures arranged in parallel in the second direction are arrayed with the wave shape reversed in a right-and-left direction against flat pipes of the plurality of flat pipes of an other passage structure of the two passage structures.

7. The finless heat exchanger of claim 1, wherein each of the flat surfaces of the plurality of flat pipes has the corrugations in the wave shape with the mountain fold lines and the valley fold lines of the wave shape that continues from the side corresponding to the one side surface to the side corresponding to the other side surface in the width direction, and wherein the mountain fold lines and the valley fold lines of the wave shape of each of the plurality of flat pipes are provided in the horizontal direction to be aligned in height with the mountain fold lines and the valley fold lines of the flat pipe of the plurality of flat pipes that is adjacent.

8. The finless heat exchanger of claim 1, wherein one of adjacent pair of flat pipes of the plurality of flat pipes is reversed to the first direction and the ones of the pairs are arrayed in a state in which the finless heat exchanger is placed.

9. The finless heat exchanger of claim 4, wherein the first direction and the second direction are horizontally oriented, wherein each of the flat surfaces of the plurality of flat pipes has the corrugations in the wave shape with the mountain fold lines and the valley fold lines of the wave shape that continues from the side corresponding to the one side surface to the side corresponding to the other side surface in the width direction, wherein mountain fold lines and valley fold lines of a wave shape of flat pipes of the plurality of flat pipes of one passage structure of the two passage structures arranged in parallel are provided in the horizontal direction to be aligned in height with mountain fold lines and valley fold lines of the flat pipe of the plurality of flat pipes that is adjacent, and wherein mountain fold lines and valley fold lines of a wave shape of flat pipes of the plurality of flat pipes of an other passage structure are inclined in an oblique direction to the horizontal direction to be aligned in height with mountain fold lines and valley fold lines of the flat pipe of the plurality of flat pipes that is adjacent.

10. The finless heat exchanger of claim 1, wherein the plurality of flat pipes are arrayed at a pitch that is equal to or smaller than an amplitude of the wave shape.

11. The finless heat exchanger of claim 1, wherein the plurality of flat pipes each have a sinusoidal wave shape or a triangular wave shape as viewed in the second direction.

12. The finless heat exchanger of claim 1, wherein, in each of the plurality of flat pipes, when an amplitude of the wave shape is represented by h, and a wavelength of the wave shape is represented by L, a value of h/L of a wave shape located on a lower side in a gravity direction in a state in which the finless heat exchanger is placed is smaller than a value of h/L of a wave shape located on an upper side in the gravity direction.

13. The finless heat exchanger of claim 1, wherein the finless heat exchanger is operated as a cooler in which a temperature of a fluid flowing through a plurality of passages of the each of the plurality of flat pipes is lower than an air flow temperature.

14. An outdoor unit of an air-conditioning apparatus, comprising:

a casing having an air inlet and an air outlet;

a compressor provided inside the casing;

an air-sending device provided inside the casing, and configured to suck air through the air inlet, and to blow out the air through the air outlet; and the finless heat exchanger of claim 1 provided inside the casing in an air passage between the air inlet and the air outlet.

15. An indoor unit of an air-conditioning apparatus, comprising:

a casing having an air inlet and an air outlet;

an air-sending device provided inside the casing, and configured to generate a flow of air from the air inlet to the air outlet; and the finless heat exchanger of claim 1 provided inside the casing in an air passage between the air inlet and the air outlet.

16. The indoor unit of the air-conditioning apparatus of claim 15, wherein the finless heat exchanger is installed such that a pipe passage direction of the plurality of flat pipes is inclined to a gravity direction at an angle in a range of from 0 degrees or more to 45 degrees or less.

17. A finless heat exchanger, comprising:

a pair of headers each including a pipe-shaped portion extending in a first direction, and a plurality of branching portions formed on the pipe-shaped portion at a predetermined interval in the first direction; and a pipe group including a plurality of flat pipes each having a flat sectional shape elongated in one direction, the plurality of flat pipes being arrayed in the first direction and connecting between the plurality of branching portions of one of the pair of headers and the plurality of branching portions of an other of the pair of headers, the finless heat exchanger having at least one passage structure in which a flat surface of one of adjacent two flat pipes and a flat surface of an other of the adjacent two flat pipes of the plurality of flat pipes of the pipe group face each other and in which the adjacent two flat pipes of the plurality of flat pipes of the pipe group each have a side surface facing a second direction orthogonal to the first direction, the finless heat exchanger being configured to exchange heat between air flowing through spaces defined by the plurality of flat pipes and refrigerant while the refrigerant is supplied from one of the pair of headers to the plurality of flat pipes to flow to an other of the pair of headers, the plurality of flat pipes being each bent in a wave shape and connect between the plurality of branching portions of the one and the other of the pair of headers, and the side surface of each of the plurality of flat pipes having a wave shape as viewed in the second direction, in each of the plurality of flat pipes, when an amplitude of the wave shape is represented by h, and a wavelength of the wave shape is represented by L, a value of hi of a wave shape located on a lower side in a gravity direction in a state in which the finless heat exchanger is placed being smaller than a value of h/L of a wave shape located on an upper side in the gravity direction, the plurality of flat pipes of the pipe group that are adjacent to each other being prevented from being held in contact with each other, both the side surfaces being opened so that the air flows in from a side corresponding to one side surface in the second direction and flows out from a side corresponding to an other side surface in the second direction.

* * * * *